US011131329B2

(12) United States Patent
Nakayama et al.

(10) Patent No.: US 11,131,329 B2
(45) **Date of Patent: *Sep. 28, 2021**

(54) PNEUMATIC ACTUATOR

(71) Applicant: BRIDGESTONE CORPORATION, Tokyo (JP)

(72) Inventors: Atsushi Nakayama, Tokyo (JP); Yasunori Tarutani, Tokyo (JP); Shingo Ohno, Tokyo (JP); Yasuo Fukushima, Tokyo (JP)

(73) Assignee: BRIDGESTONE CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/861,726

(22) Filed: Apr. 29, 2020

(65) Prior Publication Data

US 2020/0256356 A1 Aug. 13, 2020

Related U.S. Application Data

(63) Continuation of application No. PCT/JP2017/039200, filed on Oct. 30, 2017.

(51) Int. Cl.
*F15B 15/10* (2006.01)

(52) U.S. Cl.
CPC ..... *F15B 15/103* (2013.01)

(58) Field of Classification Search
CPC .... F15B 15/103; F15B 15/10; F15B 15/1433; B25J 9/0006
See application file for complete search history.

(56) References Cited

U.S. PATENT DOCUMENTS 4,615,260 A 10/1986 Takagi et al.
4,721,030 A 1/1988 Paynter
(Continued)

FOREIGN PATENT DOCUMENTS

CN 1764786 A 4/2006
CN 101310115 A 11/2008
(Continued)

OTHER PUBLICATIONS

International Preliminary Report on Patentability with the translation of Written Opinion dated May 5, 2020, from the International Bureau in International Application No. PCT/JP2017/039200.
(Continued)

*Primary Examiner* — Abiy Teka
*Assistant Examiner* — Daniel S Collins
(74) *Attorney, Agent, or Firm* — Sughrue Mion, PLLC

(57) ABSTRACT

Provided is a pneumatic actuator having improved durability. A pneumatic actuator (10) comprises an actuator body (100) including: a cylindrical tube (110) configured to expand and contract by air pressure; and a cylindrical sleeve (120) formed by weaving cords (121) oriented in predetermined directions, wherein in a no-load and no-pressure state, an average angle ($\Theta_1$) of the cords (121) with respect to an axial direction ($D_{AX}$) of the actuator is 20 degrees or more and less than 45 degrees, and in a state in which an average angle ($\Theta_3$) of the cords (121) with respect to the axial direction ($D_{AX}$) of the actuator is 45 degrees with an air pressure of 5 MPa, a ratio (S2/S1) of a total area (S2) of gaps (122) of the cords (121) to an area (S1) of an outer surface of the actuator body (100) is 35% or less.

20 Claims, 12 Drawing Sheets

(56) References Cited

U.S. PATENT DOCUMENTS

| | | | | |
|---|---|---|---|---|
| 5,079,999 | A | 1/1992 | Negishi et al. | |
| 6,666,127 | B2 * | 12/2003 | Peles | B25J 9/142 92/50 |
| 7,299,741 | B2 | 11/2007 | Hiramatsu et al. | |
| 8,640,602 | B2 | 2/2014 | Nakamura et al. | |
| 10,634,171 | B2 | 4/2020 | Fuyuki | |
| 10,774,855 | B2 * | 9/2020 | Nakayama | F15B 15/10 |
| 2002/0108491 | A1 | 8/2002 | Stahn | |
| 2009/0044696 | A1 | 2/2009 | Inakazu et al. | |
| 2015/0040753 | A1 | 2/2015 | Bishop-Moser et al. | |
| 2016/0194064 | A1 | 7/2016 | Okuno | |
| 2018/0202474 | A1 | 7/2018 | Oono et al. | |
| 2018/0256434 | A1 | 9/2018 | Matsuo et al. | |

FOREIGN PATENT DOCUMENTS

| | | | |
|---|---|---|---|
| CN | 203272328 | U | 11/2013 |
| CN | 105370661 | A | 3/2016 |
| CN | 105805076 | A | 7/2016 |
| EP | 0 123 558 | A2 | 10/1984 |
| EP | 0 161 750 | B1 | 10/1988 |
| JP | 48-024175 | A | 3/1973 |
| JP | 52-40378 | A | 3/1977 |
| JP | 60-139905 | A | 7/1985 |
| JP | 60-227003 | A | 11/1985 |
| JP | 61-157803 | A | 7/1986 |
| JP | 61-236905 | A | 10/1986 |
| JP | 61-279551 | A | 12/1986 |
| JP | 62-62005 | A | 3/1987 |
| JP | 3-28507 | A | 2/1991 |
| JP | 8-170603 | A | 7/1996 |
| JP | 2000-18444 | A | 1/2000 |
| JP | 2005-524802 | A | 8/2005 |
| JP | 2009-68531 | A | 4/2009 |
| JP | 2012-207329 | A | 10/2012 |
| JP | 2012-250452 | A | 12/2012 |
| JP | 2014-121806 | A | 7/2014 |
| JP | 2014-224569 | A | 12/2014 |
| JP | 2014-224570 | A | 12/2014 |
| JP | 2016-156116 | A | 9/2016 |
| JP | 2017-046754 | A | 3/2017 |
| JP | 2017-141949 | A | 8/2017 |
| WO | 2004/085856 | A1 | 10/2004 |
| WO | 2008/140032 | A1 | 11/2008 |
| WO | 2015/146624 | A1 | 10/2015 |
| WO | 2017/010304 | A1 | 1/2017 |
| WO | 2017/138663 | A1 | 8/2017 |

OTHER PUBLICATIONS

International Search Report for PCT/JP2017/039200 dated Jan. 23, 2018 [PCT/ISA/210].

Extended European Search Report dated May 11, 2021 in European Application No. 17930230.2.

Iwata et al., "A Method of Designing and Fabricating Mckibben Muscles Driven by 7 MPa Hydraulics", Int. J. of Automation Technology, 2012, vol. 6, No. 4, pp. 482-487 (6 pages total).

Mori et al., "Development of Very High Force Hydraulic McKibben Artificial Muscle and Its Application to Shape-Adaptable Power Hand", Proceedings of the 2009 IEEE International Conference on Robotics and Biometrics, Dec. 19, 2009, pp. 1457-1462 (6 pages total).

Search Report dated Jun. 30, 2021 in U.S. Appl. No. 201780096467.2.

* cited by examiner

PNEUMATIC ACTUATOR

TECHNICAL FIELD

The present disclosure relates to a pneumatic actuator.

BACKGROUND

Conventionally, as an actuator for expanding and contracting a tube, a pneumatic actuator (so-called McKibben type) including: a rubber tube (tubular body) that expands and contracts using air as a working fluid; and a sleeve (braided reinforcing structure) that covers the outer peripheral surface of the tube is widely used (for example, see PTL 1).

Both ends of an actuator body formed by the tube and the sleeve are caulked using sealing members made of metal.

The sleeve is a cylindrical structure formed by weaving cords of high-tensile fiber such as polyamide fiber or metal, and regulates the expansion movement of the tube within a predetermined range.

Such a pneumatic actuator is used in various fields. The pneumatic actuator is particularly suitable for use as an artificial muscle in nursing or healthcare equipment.

CITATION LIST

Patent Literature

PTL 1: JP S61-236905 A

SUMMARY

Technical Problem

However, the foregoing conventional actuator does not necessarily have high strength (withstanding pressure). Particularly in the case where the sleeve is not designed appropriately, the load on the tube increases. There is thus room for improvement in durability.

It could therefore be helpful to provide a pneumatic actuator having improved durability as an actuator that uses gas as a working fluid.

Solution to Problem

We thus provide the following.

A pneumatic actuator according to the present disclosure comprises an actuator body including: a cylindrical tube configured to expand and contract by air pressure; and a sleeve that is a cylindrical structure formed by weaving cords oriented in predetermined directions and covers an outer peripheral surface of the tube, wherein in a no-load and no-pressure state, an average angle of the cords constituting the sleeve with respect to an axial direction of the actuator is 20 degrees or more and less than 45 degrees, and in a stale in which the average angle of the cords constituting the sleeve with respect to the axial direction of the actuator is 45 degrees with an air pressure of 5 MPa, a ratio S2/S1 of a total area S2 of gaps of the cords constituting the sleeve to an area S1 of an outer surface of the actuator body is 35% or less.

In such a pneumatic actuator according to the present disclosure, the sleeve is designed appropriately. Hence, the load on the tube is reduced, and the durability is improved.

In a preferred embodiment of the pneumatic actuator according to the present disclosure, the cords constituting the sleeve are made of at least one fiber material selected from polyamide fiber, polyester fiber, polyurethane fiber, rayon, acrylic fiber, and polyolefin fiber. In this case, the durability of the actuator is further improved.

In another preferred embodiment of the pneumatic actuator according to the present disclosure, the sleeve is formed by alternately crossing respectively every one cord or every two cords of a cord group oriented in one direction and every one cord or every two cords of a cord group that crosses the cord group, with a position at which cords cross each other is shifted by one cord, in this case, the durability of the actuator is further improved.

In another preferred embodiment of the pneumatic actuator according to the present disclosure, the sleeve is formed by twill weaving or plain weaving the cords. In this case, too, the durability of the actuator is further improved.

In another preferred embodiment of the pneumatic actuator according to the present disclosure, a breaking strength of the cords constituting the sleeve is 200 N or more per cord. In this case, the durability of the actuator is further improved. In the present disclosure, the breaking strength of the cords is measured in accordance with JIS L1017.

In another preferred embodiment of the pneumatic actuator according to the present disclosure, a breaking elongation of the cords constituting the sleeve is 2.0% or more. In this case, the durability of the actuator is further improved. In the present disclosure, the breaking elongation of the cords is measured in accordance with JIS L1017.

In another preferred embodiment of the pneumatic actuator according to the present disclosure, a diameter of the cords constituting the sleeve is 0.3 mm to 1.5 mm. In this case, the durability of the actuator is further improved.

In another preferred embodiment of the pneumatic actuator according to the present disclosure, a driving density of the cords constituting the sleeve is 6.8 cords/cm to 25.5 cords/cm. In this case, the durability of the actuator is further improved.

In another preferred embodiment of the pneumatic actuator according to the present disclosure, a thickness t of the tube in mm, a diameter d of the cords constituting the sleeve in mm, an average angle $\Theta_1$ of the cords constituting the sleeve with respect to the axial direction of the actuator in the no-load and no-pressure state, and an average angle $\Theta_2$ of the cords constituting the sleeve with respect to the axial direction of the actuator during contraction of the actuator satisfy the following Formula (1):

$$t > \sin\Theta_2 \cdot \frac{\sin(2\Theta_2)}{\sin(2\Theta_1)} \cdot \left(\frac{1}{\sin(2\Theta_1)} - \frac{1}{2\cos\Theta_2}\right) \cdot d. \quad (1)$$

In this case, the durability of the actuator is further improved.

Herein, the average angle $\Theta_2$ of the cords constituting the sleeve with respect to the axial direction of the actuator during contraction of the actuator is a value measured with a load of 2.5 kN and an air pressure of 5 MPa.

Further preferably, the thickness t of the tube in mm, the diameter d of the cords constituting the sleeve in mm, the average angle $\Theta_1$ of the cords constituting the sleeve with respect to the axial direction of the actuator in the no-load and no-pressure state, and the average angle $\Theta_2$ of the cords constituting the sleeve with respect to the axial direction of the actuator during contraction of the actuator satisfy the following Formula (2):

$$t > \frac{\sin(2\Theta_2)\sin(\Theta_2)}{\sin^2(2\Theta_1)} \cdot d. \quad (2)$$

In this case, the durability of the actuator is even further improved.

In another preferred embodiment of the pneumatic actuator according to the present disclosure, a twist coefficient K of the cords constituting the sleeve is 0.14 to 0.50, the twist coefficient K being defined by the following Formula (3):

$$K = T_2 \times \sqrt{0.125 \times \frac{D}{\rho}} \times 10^{-3} \quad (3)$$

where $T_2$ is a final twist count of the cords in turns/10 cm, D is a fineness of original yarns constituting the cords per yarn in dtex, and ρ is a density of the original yarns constituting the cords in g/cm$^3$, the final twist count $T_2$ in turns/10 cm being replaced with a first twist count $T_1$ in turns/10 cm in the case where the cords have a single-twist structure. In this case, the sleeve is designed appropriately, so that the load on the tube is reduced, and the durability of the actuator is further improved.

Preferably, in the pneumatic actuator according to the present disclosure, in the cords constituting the sleeve, a ratio $T_1/D$ between a first twist count $T_1$ in turns/10 cm and a fineness D of original yarns constituting the cords per yarn in dtex is 0.004 to 0.03. In this case, the durability of the actuator is further improved.

Preferably, in the pneumatic actuator according to the present disclosure, in the cords constituting the sleeve, a ratio $T_1/T_2$ between a first twist count $T_1$ in turns/10 cm and a final twist count $T_2$ in turns/10 cm is 0.8 to 1.2. In this case, the durability of the actuator is further improved.

Preferably, in the pneumatic actuator according to the present disclosure, in the cords constituting the sleeve, a fineness D of original yarns constituting the cords per yarn is 800 dtex to 5000 dtex, a first twist count $T_1$ is 3.2 turns/10 cm to 150 turns/10 cm, a final twist count $T_2$ is 2.6 turns/10 cm to 180 turns/10 cm, and a number of original yarns twisted is 2 to 4. In this case, the durability of the actuator is further improved.

In another preferred embodiment of the pneumatic actuator according to the present disclosure, a thickness of the tube is 1.0 mm to 6.0 mm in the no-load and no-pressure state. In this case, the durability of the actuator is further improved.

Advantageous Effect

It is therefore possible to provide a pneumatic actuator having improved durability.

DETAILED DESCRIPTION

A pneumatic actuator according to the present disclosure will be described in detail below based on embodiments, with reference to the drawings. The same functions or structures are given the same or similar reference signs, and their description is omitted as appropriate.

(1) Overall Schematic Structure of Pneumatic Actuator

Figure 1:
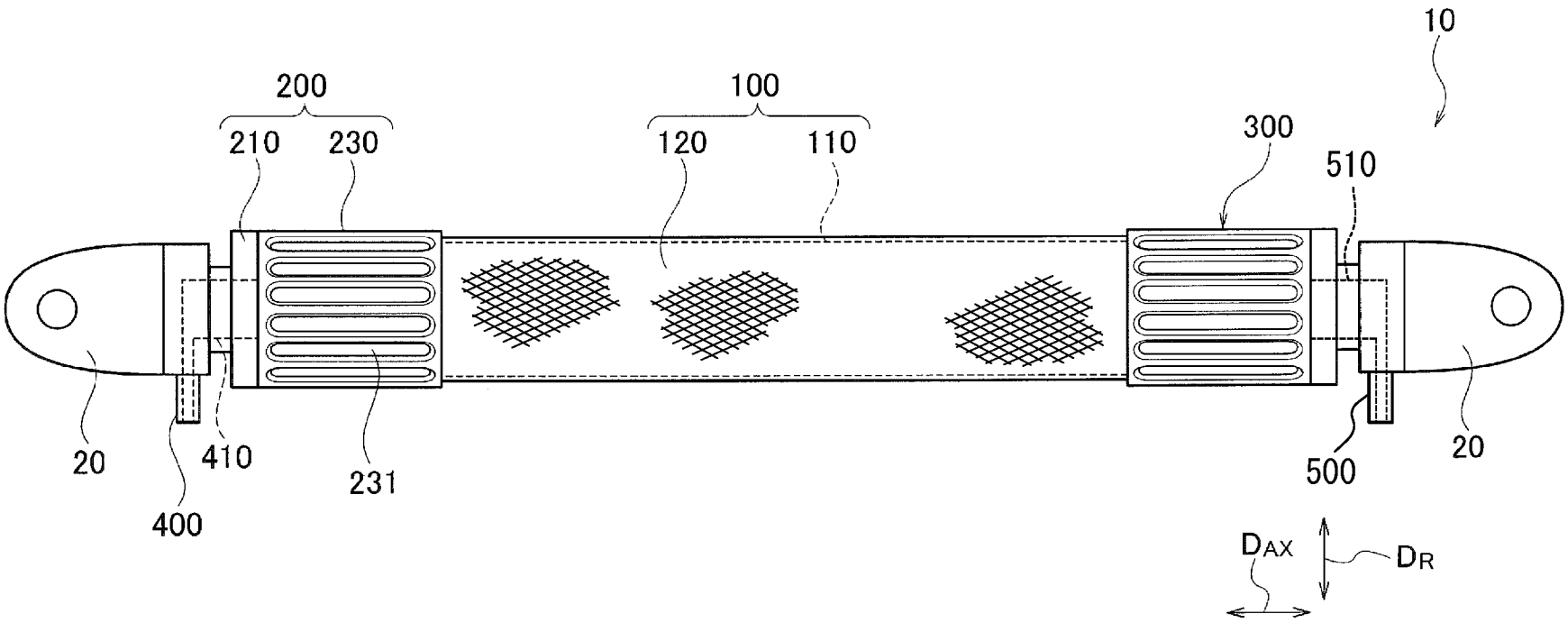
FIG. 1 is a side view of an embodiment of a pneumatic actuator 10.

FIG. 1 is a side view of a pneumatic actuator 10 according to this embodiment. As illustrated in FIG. 1, the pneumatic actuator 10 includes an actuator body 100, a sealing mechanism 200, and a sealing mechanism 300. Connection portions 20 are provided at both ends of the pneumatic actuator 10.

The actuator body 100 includes a tube 110 and a sleeve 120. A working fluid flows into the actuator body 100 via a fitting 400 and a passage hole 410. The actuator according to the present disclosure is a pneumatic actuator, and gas is used as the working fluid. Examples of the gas include air and nitrogen.

As a result of the working fluid flowing into the tube 110, the actuator body 100 contracts in the axial direction $D_{AX}$ of the actuator body 100 and expands in the radial direction $D_R$ of the actuator body 100. As a result of the working fluid flowing out of the tube 110, the actuator body 100 expands in the axial direction $D_{AX}$ of the actuator body 100 and contracts in the radial direction $D_R$ of the actuator body 100. With such shape changes of the actuator body 100, the pneumatic actuator 10 functions as an actuator.

The pneumatic actuator 10 is so-called McKibben type, and cannot only be used for an artificial muscle but also be suitable for use as a limb (upper limb, lower limb, etc.) of a robot required to have higher capability (contraction force). A member forming the limb or the like is connected to each connection portion 20.

The sealing mechanisms 200 and 300 seal both ends of the actuator body 100 in the axial direction $D_{AX}$. Specifically, the sealing mechanism 200 includes a sealing member 210 and a caulking member 230. The sealing member 210 seals an end of the actuator body 100 in the axial direction $D_{AX}$. The caulking member 230 caulks the actuator body 100, together with the sealing member 210. A pressed mark 231, i.e. a mark as a result of caulking the caulking member 230 by a jig, is formed on the outer peripheral surface of the caulking member 230.

The difference between the sealing mechanisms 200 and 300 is that fittings 400 and 500 (and passage holes 410 and 510) have different roles.

The fitting 400 provided in the sealing mechanism 200 protrudes so that a driving pressure source of the pneumatic actuator 10, specifically, a hose (pipe line) connected to a compressor for the working fluid, can be attached to the fitting 400. The working fluid flowing in through the fitting 400 passes through the passage hole 410 and enters into the actuator body 100, specifically, into the tube 110.

The fitting 500 provided in the sealing mechanism 300 protrudes so as to be used for degassing when the working fluid is injected into the actuator. In an initial working stage of the actuator, when the working fluid is injected into the actuator, gas existing inside the actuator is discharged from the fitting 500 through the passage hole 510.

Figure 2:
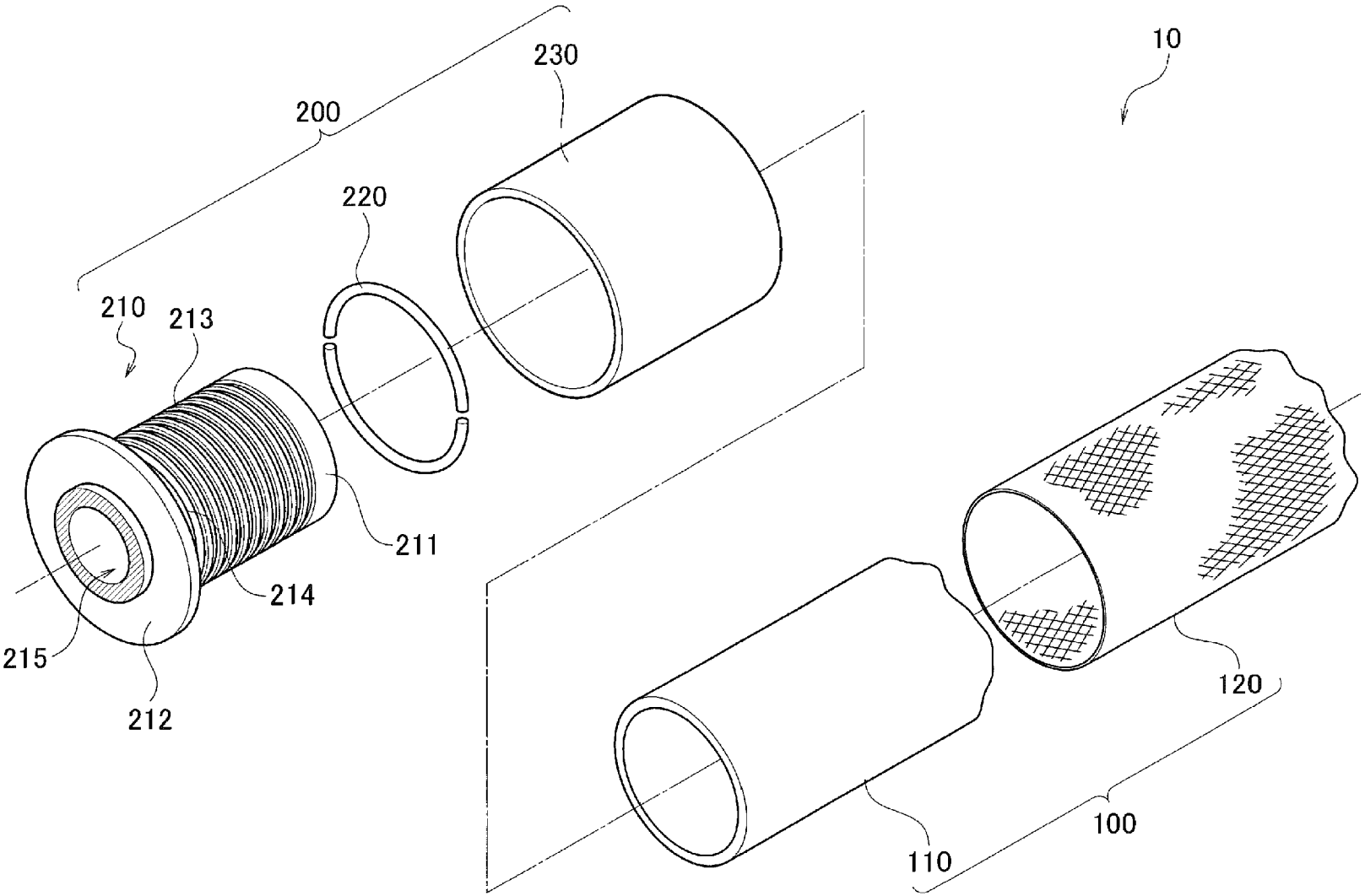
FIG. 2 is a partial exploded perspective view of the embodiment of the pneumatic actuator 10.

FIG. 2 is a partial exploded perspective view of the pneumatic actuator 10. As illustrated in FIG. 2, the pneumatic actuator 10 includes the actuator body 100 and the sealing mechanism 200.

The actuator body 100 includes the tube 110 and the sleeve 120, as mentioned above.

The tube 110 is a cylindrical tubular body that expands and contracts by air pressure. Since the tube 110 repeats contraction and expansion by the working fluid, the tube 110 is made of an elastic material such as rubber.

In a no-load and no-pressure state, the thickness of the tube 110 is preferably in a range of 1.0 mm to 6.0 mm, and more preferably in a range of 1.4 mm to 5.0 mm. If the thickness of the tube 110 is 1.0 mm or more, the strength of the tube 110 increases, and the tube 110 is kept from sticking out of gaps of the cords constituting the sleeve 120. Hence, the durability of the actuator is further improved. If the thickness of the tube 110 is 6.0 mm or less, the contraction coefficient of the tube 110 increases, with it being possible to ensure sufficient operation length.

The tube 110 illustrated in FIGS. 1 and 2 has a single-layer structure. In the present disclosure, however, the tube may have a structure of two or more layers. The diameter (outer diameter) of the tube 110 may be selected as appropriate depending on the intended use.

The sleeve 120 is cylindrical, and covers the outer peripheral surface of the tube 110. The sleeve 120 is a structure formed by weaving cords oriented in predetermined directions. The oriented cords intersect each other to repeatedly form a rhombus shape. Such a shape allows the sleeve 120 to deform like a pantograph and follow the contraction and expansion of the tube 110 while regulating the contraction and expansion.

Figure 3A:
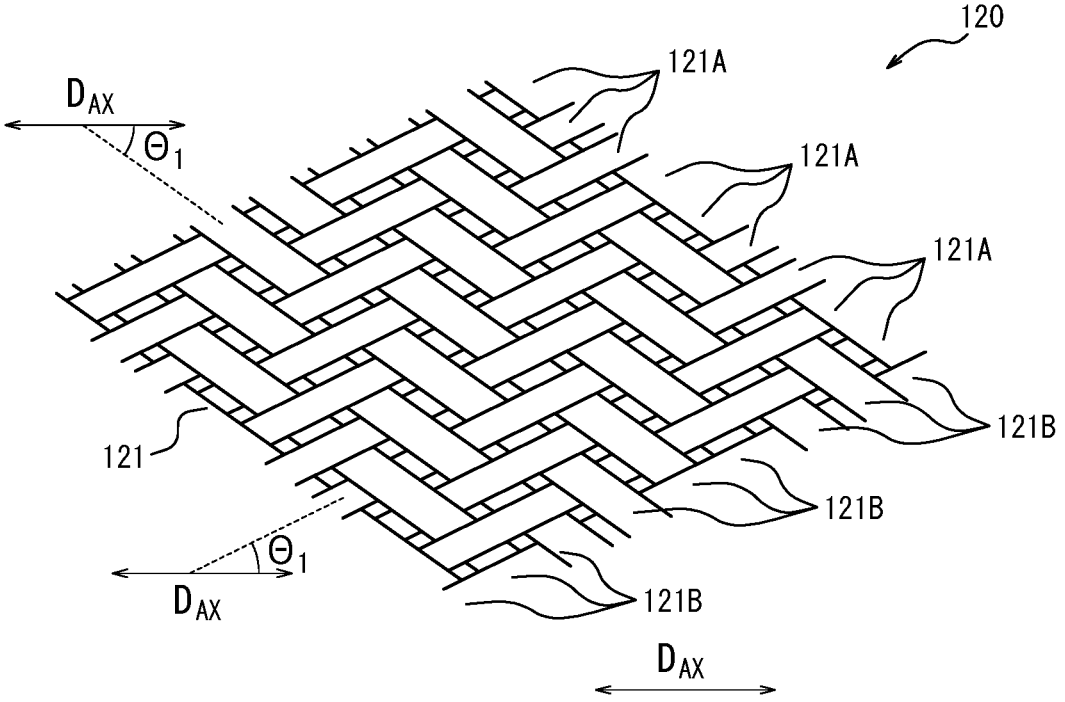
FIG. 3A is a partial side view of an embodiment of a sleeve 120 in a no-load and no-pressure state and FIG. 3B is a partial side view of another embodiment of the sleeve 120 in a no-load and no-pressure state.
Figure 3B:
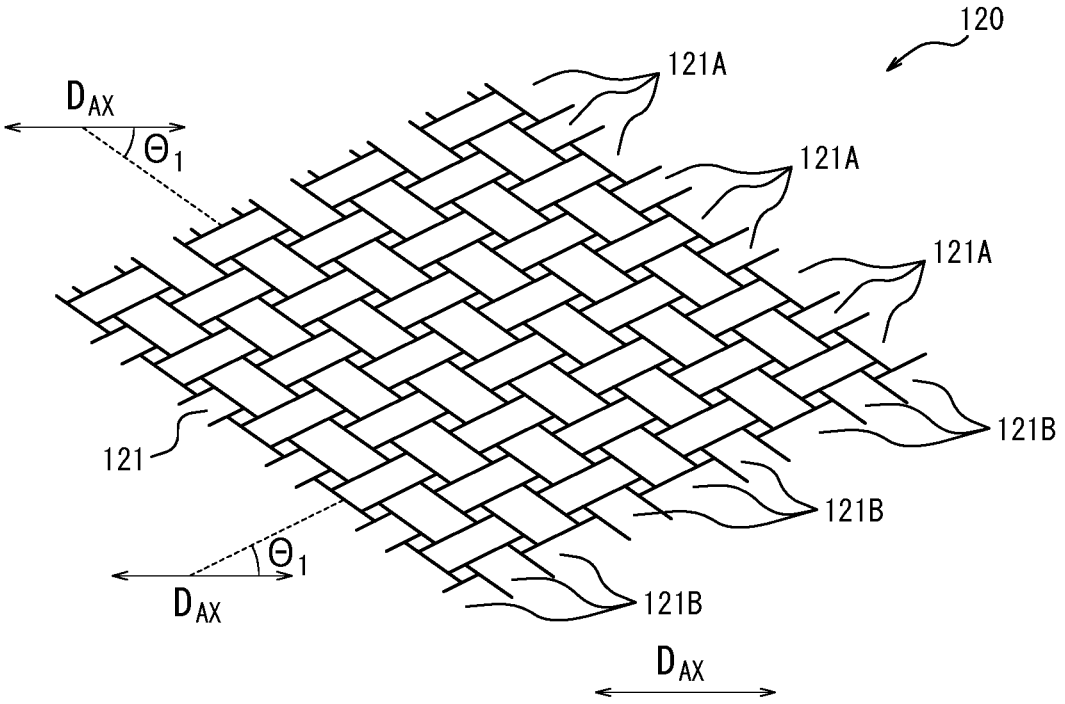

FIGS. 3A and 3B are partial side views of two embodiments of the sleeve 120 in a no-load and no-pressure state.

In the present disclosure, in a no-load and no-pressure state (i.e. initial state), the average angle $\Theta_1$ of the cords 121 constituting the sleeve 120 with respect to the axial direction $D_{AX}$ of the actuator is 20 degrees or more and less than 45 degrees, as illustrated in FIGS. 3A and 3B. As a result of the average angle $\Theta_3$ of the cords 121 constituting the sleeve 120 with respect to the axial direction $D_{AX}$ of the actuator being 20 degrees or more in the no-load and no-pressure state, the durability of the sleeve 120 is improved. If the average angle of the cords 121 constituting the sleeve 120 with respect to the axial direction $D_{AX}$ of the actuator is more than 45 degrees in the no-load and no-pressure state, the contraction of the actuator during working is small, causing insufficient actuator function.

The average angle $\Theta_1$ is preferably 22 degrees or more, and more preferably 23 degrees or more. When the average angle $\Theta_1$ is greater, the load on the tube 110 is lighter, so that damage of the part of the tube 110 not in direct contact with the cords 121 is suppressed. Hence, the actuator function can be maintained for a long period of time.

The average angle $\Theta_1$ is preferably 37 degrees or less. If the average angle $\Theta_1$ is 37 degrees or less, the contraction coefficient of the actuator increases, with it being possible to ensure sufficient operation length.

The average angle $\Theta_1$ of the cords 121 constituting the sleeve 120 with respect to the axial direction $D_{AX}$ of the actuator in the initial state can be adjusted, for example, by adjusting the directions of the cords 121 when weaving the sleeve 120 and further adjusting the directions of the cords 121 when shaping the sleeve 120 into a cylinder.

Figure 4A:
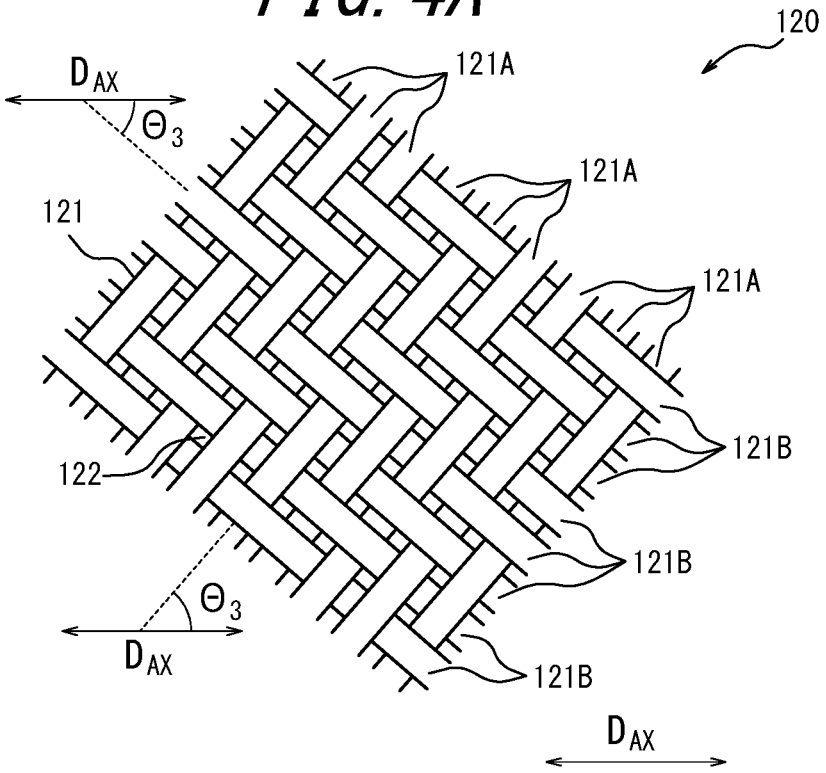
FIG. 4A is a partial side view of an embodiment of the sleeve 120 in a state in which the average angle of cords 121 constituting the sleeve 120 with respect to the axial direction of the actuator is 45 degrees and FIG. 4B is a partial side view of another embodiment of the sleeve 120 in a state in which the average angle of the cords 121 constituting the sleeve 120 with respect to the axial direction of the actuator is 45 degrees.
Figure 4B:
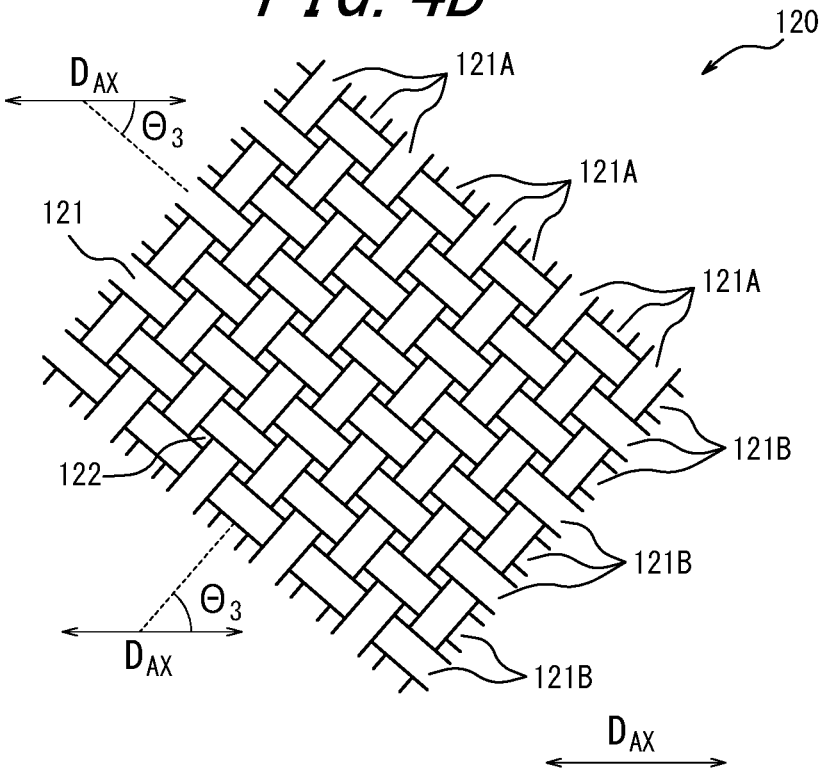

FIGS. 4A and 4B are partial side views of two embodiments of the sleeve 120 in a state in which the average angle of the cords 121 constituting the sleeve 120 with respect to the axial direction $D_{AX}$ of the actuator is 45 degrees. In the present disclosure, an error range of ±1 degree is allowed when measuring the angle of the cords 121.

In the present disclosure, in a state in which the average angle $\Theta_3$ of the cords 121 constituting the sleeve 120 with respect to the axial direction $D_{AX}$ of the actuator is 45 degrees with an air pressure of 5 MPa, the ratio (S2/S1) of the total area (S2) of the gaps 122 of the cords 121 constituting the sleeve 120 to the area (S1) of the outer surface of the actuator body 100 is 35% or less, preferably 32% or less, more preferably 30% or less, further preferably 25% or less, and particularly preferably 20% or less, as illustrated in FIGS. 4A and 4B. As a result of the ratio (S2/S1) of the total area (S2) of the gaps 122 of the cords 121 constituting the sleeve 120 to the area (S1) of the outer surface of the actuator body 100 being 35% or less in a state in which the average angle $\Theta_3$ of the cords 121 constituting the sleeve 120 with respect to the axial direction $D_{AX}$ of the actuator is 45 degrees, i.e. in a state in which the average intersection angle of the cords 121 is 90 degrees, the load on the tube 110 is reduced, and the durability of the actuator is improved. No lower limit is placed on the ratio (S2/S1), but the ratio (S2/S1) is preferably 5% or more from the perspective of the operation length of the actuator.

The total area (S2) of the gaps 122 of the cords 121 constituting the sleeve 120 can be adjusted by selecting the method of weaving the sleeve 120, the diameter, material, and driving density of the cords 121 used, etc.

In the present disclosure, the total area (S2) of the gaps 122 of the cords 121 constituting the sleeve 120 is measured after adjusting the load on the actuator so that the average angle $\Theta_3$ of the cords 121 constituting the sleeve 120 with respect to the axial direction $D_{AX}$ of the actuator is 45 degrees with an air pressure of 5 MPa. Here, evaluation is performed in a region in which the diameter of the sleeve 120 is within a range of −5% with respect to the maximum diameter of the sleeve 120, and the ratio (S2/S1) is calculated where S2 is the total area of the gaps 122 in the region and S1 is the area of the outer surface of the actuator body 100 in the region. The area of each of the gaps 122 of the cords 121 constituting the sleeve 120 corresponds to the area in which there is no cord 121 and the tube 110 located inside is exposed when the sleeve is seen from outside.

In the present disclosure, each of the average angles $\Theta_1$, $\Theta_2$, $\Theta_3$ with respect to the axial direction $D_{AX}$ of the actuator denotes the acute angle between the cords 121 and the axial direction $D_{AX}$ of the actuator.

The cords 121 constituting the sleeve 120 are preferably fiber cords made of at least one fiber material selected from polyamide fiber such as aramid fiber (aromatic polyamide fiber), polyhexamethylene adipamide (nylon 6,6) fiber, and polycaprolactam (nylon 6) fiber, polyester fiber such as polyethylene terephthalate (PET) fiber and polyethylene naphthaiate (PEN) fiber, polyurethane fiber, rayon, acrylic fiber, and polyolefin fiber. In this case, the durability of the sleeve is further improved. Of these, cords made of aramid fiber are particularly preferable from the perspective of the strength of the sleeve 120.

The cords 121 are not limited to these types of fiber cords. For example, cords made of high-strength fiber such as poly(paraphenylene benzobisoxazole) (PBO) fiber or metal cords formed by ultrafine filaments may be used.

The foregoing fiber cords or metal cords may have their surfaces coated with rubber, a mixture of thermosetting resin and latex, or the like. In the case where the surfaces of the cords are coated with such material, the coefficient of friction of the surfaces of the cords can be reduced moderately while enhancing the durability of the cords.

The solid content in the mixture of thermosetting resin and latex is preferably 15 mass % or more and 50 mass % or less, and more preferably 20 mass % or more and 40 mass % or less. Examples of the thermosetting resin include phenol resin, resorcin resin, and urethane resin. Examples of the latex include vinylpyridine (VP) latex, styrene-butadiene rubber (SBR) latex, and acrylonitrile-butadiene rubber (NBR) latex.

In the present disclosure, the sleeve 120 is preferably formed by alternately crossing every two cords 121 of a cord group 121A oriented in one direction and every two cords 121 of a cord group 121B that crosses the cord group 121A where the crossing position is shifted by one cord, i.e. the sleeve 120 is preferably formed by twill weave (twill), as illustrated in FIGS. 3A and 4A. In this case, the load on the tube 110 is further reduced, and the durability of the actuator is further improved.

In the present disclosure, the sleeve 120 is also preferably formed by alternately crossing every one cord 121 of the cord group 121A oriented in one direction and every one cord 121 of the cord group 121B that crosses the cord group 121A, i.e. the sleeve 120 is preferably formed by plain weave, as illustrated in FIGS. 3B and 4B. In this case, too, the load on the tube 110 is further reduced, and the durability of the actuator is further improved.

In the present disclosure, the sleeve 120 is also preferably formed by basket weaving the cords 121. In this case, too, the load on the tube 110 is further reduced, and the durability of the actuator is further improved. Although no limit is placed on the number of cords paralleled in basket weave, in the present disclosure it is preferable to parallel two cords and drive other two cords paralleled separately.

In the present disclosure, the breaking strength of the cords 121 constituting the sleeve 120 is preferably 200 N or more per cord, more preferably in a range of 250 N per cord to 1000 N per cord, further preferably in a range of 300 N per cord to 1000 N per cord, still further preferably in a range of 500 N per cord to 1000 N per cord, and particularly preferably in a range of 600 N per cord to 1000 N per cord. In this case, the load on the tube 110 is further reduced, and the durability of the actuator is further improved.

In the present disclosure, the breaking elongation of the cords 121 constituting the sleeve 120 is preferably 2.0% or more, and more preferably in a range of 3.0% to 6.0%. In this case, the load on the tube 110 is further reduced, and the durability of the actuator is further improved.

In the present disclosure, the diameter of the cords 121 constituting the sleeve 120 is preferably 0.3 mm to 1.5 mm, more preferably 0.4 mm to 1.5 mm, further preferably 0.5 mm to 1.5 mm, still further preferably 0.6 mm to 1.3 mm, and particularly preferably 0.6 mm to 1.0 mm. In this case, the load on the tube 110 is further reduced, and the durability of the actuator is further improved.

In the present disclosure, the driving density of the cords 121 constituting the sleeve 120 is preferably 6.8 cords/cm to 25.5 cords/cm, more preferably 10.0 cords/cm to 23.5 cords/cm, and further preferably 10.0 cords/cm to 20.0 cords/cm. In this case, the load on the tube 110 is further reduced, and the durability of the actuator is further improved.

In the present disclosure, it is preferable that the thickness t (mm) of the tube 110, the diameter d (mm) of the cords 121 constituting the sleeve 120, the average angle $\Theta_1$ of the cords 121 constituting the sleeve 120 with respect to the axial direction $D_{AX}$ of the actuator in a no-load and no-pressure state, and the average angle $\Theta_2$ of the cords 121 constituting the sleeve 120 with respect to the axial direction $D_{AX}$ of the actuator during contraction of the actuator satisfy the following Formula (1):

$$t > \sin\Theta_2 \cdot \frac{\sin(2\Theta_2)}{\sin(2\Theta_1)} \cdot \left(\frac{1}{\sin(2\Theta_1)} - \frac{1}{2\cos\Theta_2}\right) \cdot d. \quad (1)$$

In the case where Formula (1) is satisfied, the load on the tube 110 is further reduced, and the durability of the actuator is further improved.

It is more preferable that the thickness t (mm) of the tube 110, the diameter d (mm) of the cords 121 constituting the sleeve 120, the average angle $\Theta_1$ of the cords 121 constituting the sleeve 120 with respect to the axial direction $D_{AX}$ of the actuator in a no-load and no-pressure state, and the average angle $\Theta_2$ of the cords 121 constituting the sleeve 120 with respect to the axial direction $D_{AX}$ of the actuator during contraction of the actuator satisfy the following Formula (2):

$$t > \frac{\sin(2\Theta_2)\sin(\Theta_2)}{\sin^2(2\Theta_1)} \cdot d. \quad (2)$$

In the case where Formula (2) is satisfied, the load on the tube 110 is further reduced, and the durability of the actuator is further improved.

In the present disclosure, the twist coefficient K of the cords 121 constituting the sleeve 120 is preferably 0.14 to 0.50, and more preferably 0.16 to 0.50. The twist coefficient K is defined by the following Formula (3):

$$K = T_2 \times \sqrt{0.125 \times \frac{D}{\rho}} \times 10^{-3} \quad (3)$$

where $T_2$ is the final twist count (turns/10 cm) of the cords (in the case where the cords have a single-twist structure, the final twist count $T_2$ (turns/10 cm) is replaced with the first twist count $T_1$ (turns/10 cm)), D is the fineness (dtex) of the original yarns constituting the cords per yarn, and ρ is the density (g/cm$^3$) of the original yarns constituting the cords. In the case where the twist coefficient K of the cords 121 constituting the sleeve 120 is 0.14 or more, the load on the fibers is reduced, and the durability of the actuator is further improved, in the case where the twist coefficient K of the cords 121 constituting the sleeve 120 is 0.50 or less, the load on the tube is reduced, and the durability of the actuator is further improved.

The twist coefficient K of the cords 121 can be adjusted by selecting the density or fineness of the original yarns used or adjusting the first twist count when forming the cords.

In the present disclosure, in the cords 121 constituting the sleeve 120, the ratio ($T_1$/D) between the first twist count $T_1$ (turns/10 cm) and the fineness D (dtex) of the original yarns constituting the cords 121 per yarn is preferably 0.004 to 0.03, and more preferably 0.004 to 0.02. In this case, the load on the lube 110 is further reduced, and the durability of the actuator is further improved.

In the present disclosure, in the cords 121 constituting the sleeve 120, the ratio ($T_1/T_2$) between the first twist count $T_1$ (turns/10 cm) and the final twist count $T_2$ (turns/10 cm) is preferably 0.8 to 1.2, and more preferably 0.9 to 1.1. In this case, the load on the tube 110 is further reduced, and the durability of the actuator is further improved.

In the present disclosure, in the cords 121 constituting the sleeve 120, the fineness D of the original yarns constituting the cords 121 per yarn is preferably 800 dtex to 5000 dtex, more preferably 800 dtex to 4000 dtex, further preferably 1000 dtex to 4000 dtex, still further preferably 1500 dtex to 4000 dtex, and particularly preferably 2000 dtex to 4000 dtex. In this case, the load on the tube 110 is further reduced, and the durability of the actuator is further improved.

In the present disclosure, in the cords 121 constituting the sleeve 120, the first twist count $T_1$ is preferably 3.2 turns/10 cm to 150 turns/10 cm, more preferably 10 turns/10 cm to 36 turns/10 cm, and further preferably 10 turns/10 cm to 30 turns/10 cm. In this case, the load on the tube 110 is further reduced, and the durability of the actuator is further improved.

In the present disclosure, in the cords 121 constituting the sleeve 120, the final twist count $T_2$ is preferably 2.6 turns/10 cm to 180 turns/10 cm, more preferably 10 turns/10 cm to 36 turns/10 cm, and further preferably 10 turns/10 cm to 30 turns/10 cm. In this case, the load on the lube 110 is further reduced, and the durability of the actuator is further improved.

In the present disclosure, in the cords 121 constituting the sleeve 120, the number of original yarns twisted is preferably 2 to 4, and particularly preferably 2. In this case, the load on the tube 110 is further reduced, and the durability of the actuator is further improved.

In the present disclosure, it is preferable that, in the cords 121 constituting the sleeve 120, the fineness D of the original yarns constituting the cords 121 per yarn is 800 dtex to 5000 dtex, the first twist count $T_1$ is 3.2 turns/10 cm to 150 turns/10 cm, the final twist count $T_2$ is 2.6 turns/10 cm to 180 turns/10 cm, and the number of original yarns twisted is 2 to 4. In the case where the fineness D of the original yarns per yarn, the first twist count $T_1$, the final twist count $T_2$, and the number of original yarns twisted in the cords 121 constituting the sleeve 120 all satisfy the foregoing preferable ranges, the load on the tube 110 is particularly reduced, and the durability of the actuator is significantly improved.

The method of producing the cords 121 is not limited. In the case where the cords 121 have a double-twist structure formed by twisting a plurality of original yarns and preferably two to four original yarns, for example, a twisted yarn cord can be obtained by subjecting original yarns to first twist and then subjecting a plurality of first twisted yarns to final twist in the opposite direction.

In the case where the cords 121 have a single-twist structure formed by twisting one original yarn, for example, a twisted yarn cord can be obtained by paralleling an original yarn and twisting it in one direction. In the present disclosure, in the case where the cords 121 have a single-twist structure, the term "first twist count $T_1$" denotes the twist count when twisting one original yarn. In the case where the cords 121 have a single-twist structure, the final twist count $T_2$ (turns/10 cm) in Formula (1) is replaced with the first twist count $T_1$ (turns/10 cm). That is, in the case where the cords 121 have a single-twist structure, $T_2$ in Formula (1) denotes the twist count when twisting one original yarn.

In FIG. 2, the sealing mechanism 200 seals the end of the actuator body 100 in the axial direction $D_{AX}$. The sealing mechanism 200 includes the sealing member 210, a first locking ring 220, and the caulking member 230.

The scaling member 210 includes a body portion 211 and a flange portion 212. As the material of the sealing member 210, metal such as stainless steel is preferably used. The material of the sealing member 210 is, however, not limited to metal, and may be a hard plastic material or the like.

The body portion 211 has a circular tube shape, A passage hole 215 through which the working fluid passes is formed in the body portion 211. The passage hole 215 communicates with the passage hole 410 (see FIG. 1). The body portion 211 is inserted into the tube 110.

The flange portion 212 connects to the body portion 211, and is located closer to the end of the pneumatic actuator 10 in the axial direction $D_{AX}$ than the body portion 211. The flange portion 212 has a larger outer diameter along the radial direction $D_R$ than the body portion 211. The flange portion 212 locks the tube 110 into which the body portion 211 is inserted and the first locking ring 220.

A recess and projection portion 213 is formed on the outer peripheral surface of the body portion 211. The recess and projection portion 213 prevents the tube 110 into which the body portion 211 is inserted, from slipping. It is preferable that three or more projections are formed by the recess and projection portion 213.

A first small diameter portion 214 smaller in outer diameter than the body portion 211 is formed in a part of the body portion 211 near the flange portion 212. The shape of the first small diameter portion 214 will be described in detail later, with reference to FIG. 5 and the subsequent drawings.

The first locking ring 220 locks the sleeve 120. Specifically, the sleeve 120 is folded outward in the radial direction $D_R$ via the first locking ring 220 (not illustrated in FIG. 2, see FIG. 5).

The outer diameter of the first locking ring 220 is larger than the outer diameter of the body portion 211. The first locking ring 220 locks the sleeve 120 at a position of the first small diameter portion 214 of the body portion 211. That is, the first locking ring 220 locks the sleeve 120 at a position that is on the outer side of the body portion 211 in the radial direction $D_R$ and adjacent to the flange portion 212.

In this embodiment, the first locking ring 220 is divided into two parts, in order to lock the sleeve 120 at the first small diameter portion 214 smaller than the body portion 211. The first locking ring 220 is, however, not limited to a two-division shape, and may be divided into more parts. Moreover, part of the divided parts may be connected rotatably.

As the material of the first locking ring 220, the same material as the sealing member 210, such as metal or a hard plastic material, may be used.

The caulking member 230 caulks the actuator body 100, together with the sealing member 210. As the material of the caulking member 230, metal such as an aluminum alloy, brass, or iron may be used. The pressed mark 231 illustrated in FIG. 1 is formed on the caulking member 230 as a result of the caulking member 230 being caulked by a caulking jig.

(2) Structure of Sealing Mechanism

Embodiments of the sealing mechanism 200 will be described below, with reference to FIGS. 5 to 12.

(2.1) Embodiment 1-1

Figure 5:
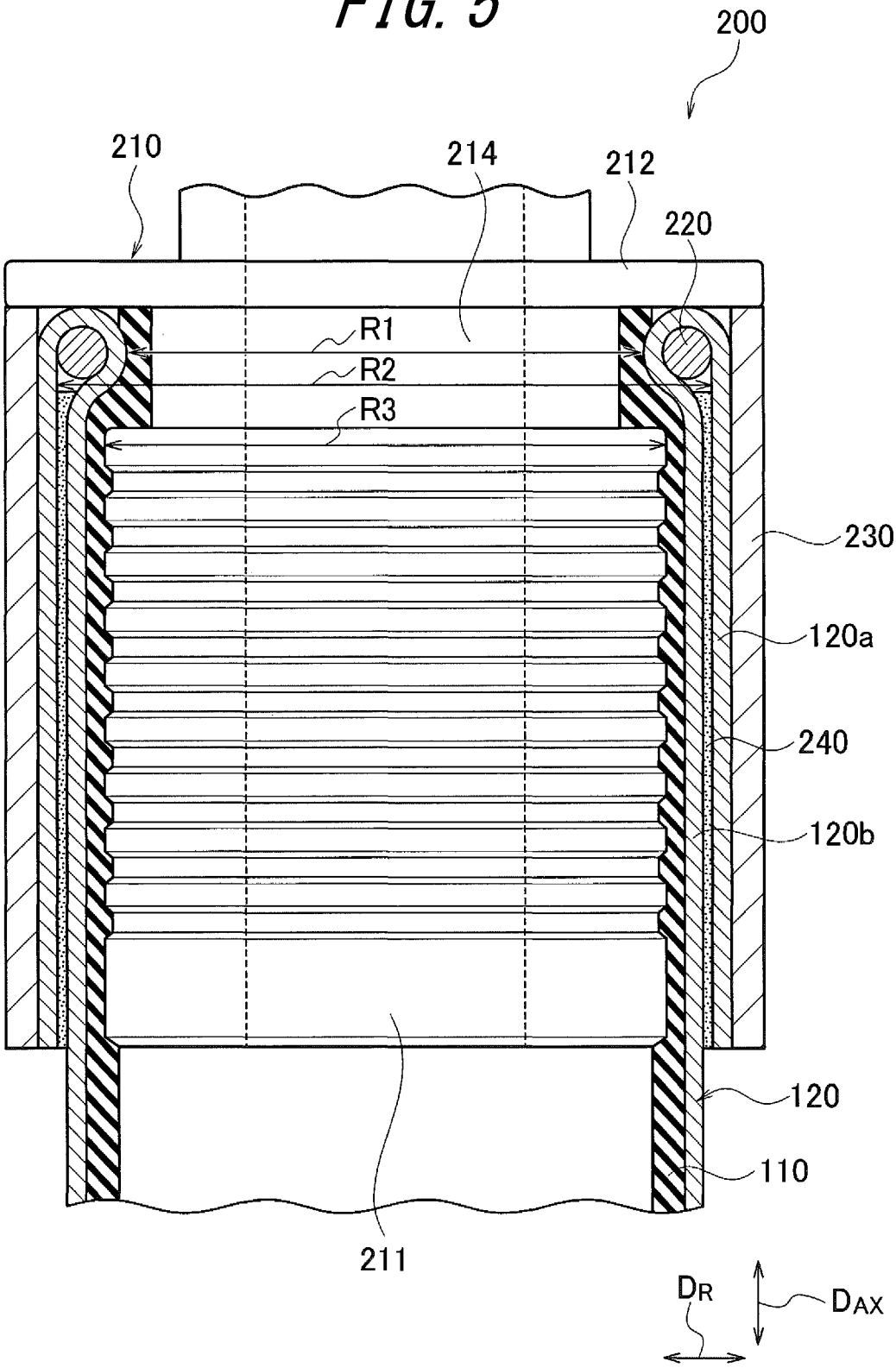
FIG. 5 is a partial cross-sectional view along the axial direction $D_{AX}$ of the pneumatic actuator 10 including a scaling mechanism 200 according to Embodiment 1-1.

FIG. 5 is a partial cross-sectional view along the axial direction $D_{AX}$ of the pneumatic actuator 10 including the sealing mechanism 200 according to Embodiment 1-1.

The sealing member 210 includes the first small diameter portion 214 whose outer diameter is smaller than the outer diameter of the body portion 211, as mentioned above.

The first locking ring 220 is located on the outer side of the first small diameter portion 214 in the radial direction $D_R$. The inner diameter R1 of the first locking ring 220 is smaller than the outer diameter R3 of the body portion 211. The outer diameter R2 of the first locking ring 220 may be smaller than the outer diameter R3 of the body portion 211.

The body portion 211 is inserted into the tube 110 until the tube 110 comes into contact with the flange portion 212. The sleeve 120 is folded outward in the radial direction $D_R$ via the first locking ring 220. The sleeve 120 thus includes a first folded portion 120*a* folded via the first locking ring 220 at the end in the axial direction $D_{AX}$. Specifically, the sleeve 120 includes: a sleeve body portion 120*b* covering the outer peripheral surface of the tube 110: and the first folded portion 120*a* located on the outer peripheral side of the sleeve body portion 120*b* as a result of being folded at the end of the sleeve body portion 120*b* in the axial direction $D_{AX}$.

The first folded portion 120*a* is adhered to the sleeve body portion 120*b* located on the outer side of the tube 110 in the radial direction $D_R$. Specifically, an adhesion layer 240 is formed between the sleeve body portion 120*b* and the first folded portion 120*a*, and adheres the sleeve body portion 120*b* and the first folded portion 120*a* to each other. As the adhesion layer 240, an appropriate adhesive may be used depending on the type of the cords constituting the sleeve 120.

In the present disclosure, the adhesion layer 240 is optional, and the first folded portion 120*a* may not be adhered to the sleeve body portion 120*b*.

The caulking member 230 is larger than the outer diameter of the body portion 211 of the sealing member 210. The caulking member 230 having the body portion 211 inserted therein is caulked by a jig. The caulking member 230 caulks the actuator body 100, together with the sealing member 210. Specifically, the caulking member 230 caulks the tube 110 into which the body portion 211 is inserted, the sleeve body portion 120*b*, and the first folded portion 120*a*. That is, the caulking member 230 caulks the tube 110, the sleeve body portion 120*b*, and the first folded portion 120*a*, together with the sealing member 210.

(2.2) Embodiment 1-2

Figure 6:
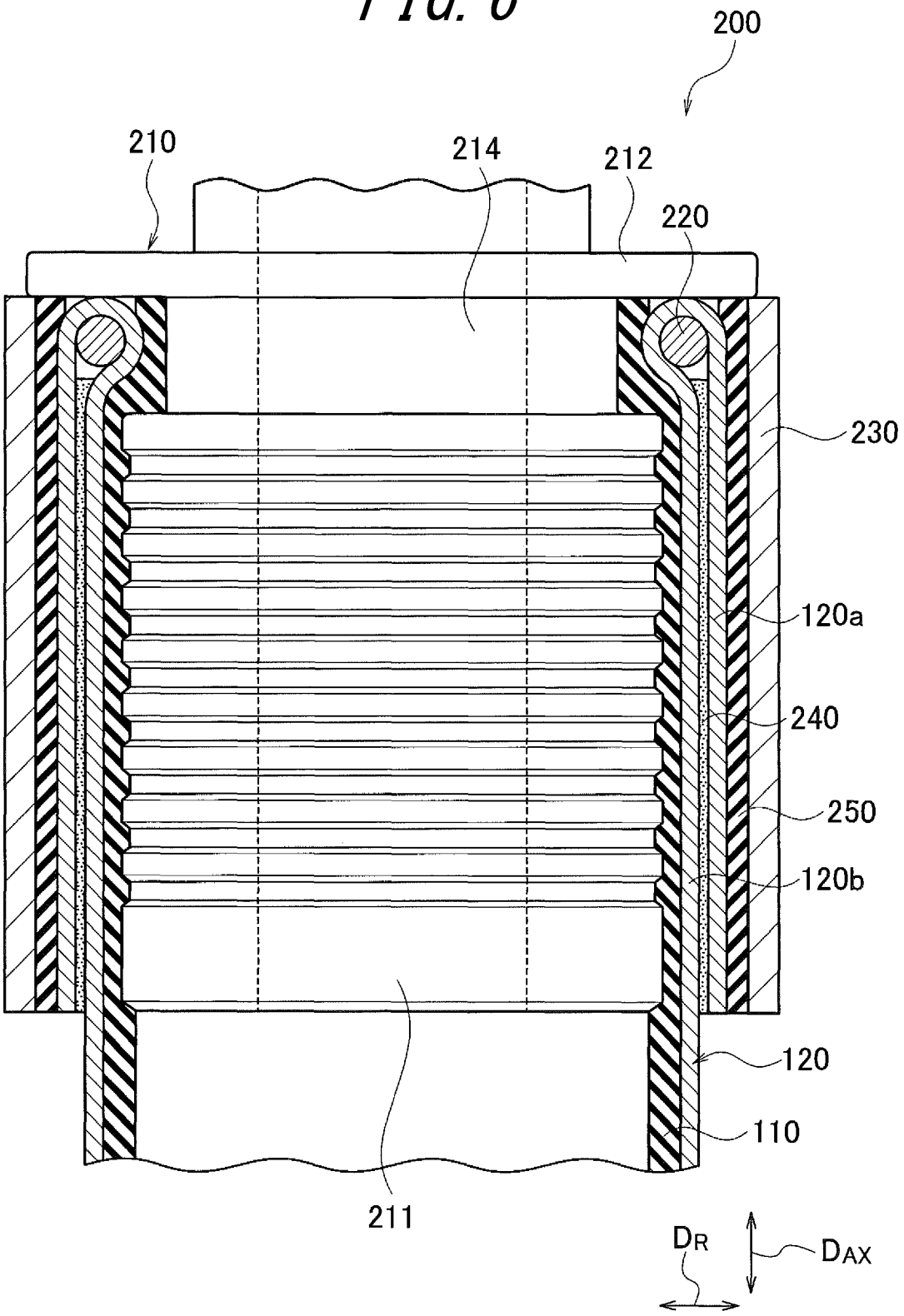
FIG. 6 is a partial cross-sectional view along the axial direction $D_{AX}$ of the pneumatic actuator 10 including the sealing mechanism 200 according to Embodiment 1-2.

FIG. 6 is a partial cross-sectional view along the axial direction $D_{AX}$ of the pneumatic actuator 10 including the sealing mechanism 200 according to Embodiment 1-2. The differences from Embodiment 1-1 will be mainly described below.

In Embodiment 1-2, a sheet-like elastic member is provided between the first folded portion 120*a* of the sleeve 120 and the caulking member 230. Specifically, a rubber sheet 250 is provided between the first folded portion 120*a* and the caulking member 230. The rubber sheet 250 is provided so as to cover the outer peripheral surface of the cylindrical first folded portion 120*a*. The type of the rubber sheet 250 is not limited. For example, the same type of rubber as the tube 110 may be used. The caulking member 230 caulks not only the actuator body 100 but also the rubber sheet 250, together with the sealing member 210.

(2.3) Embodiment 1-3

Figure 7:
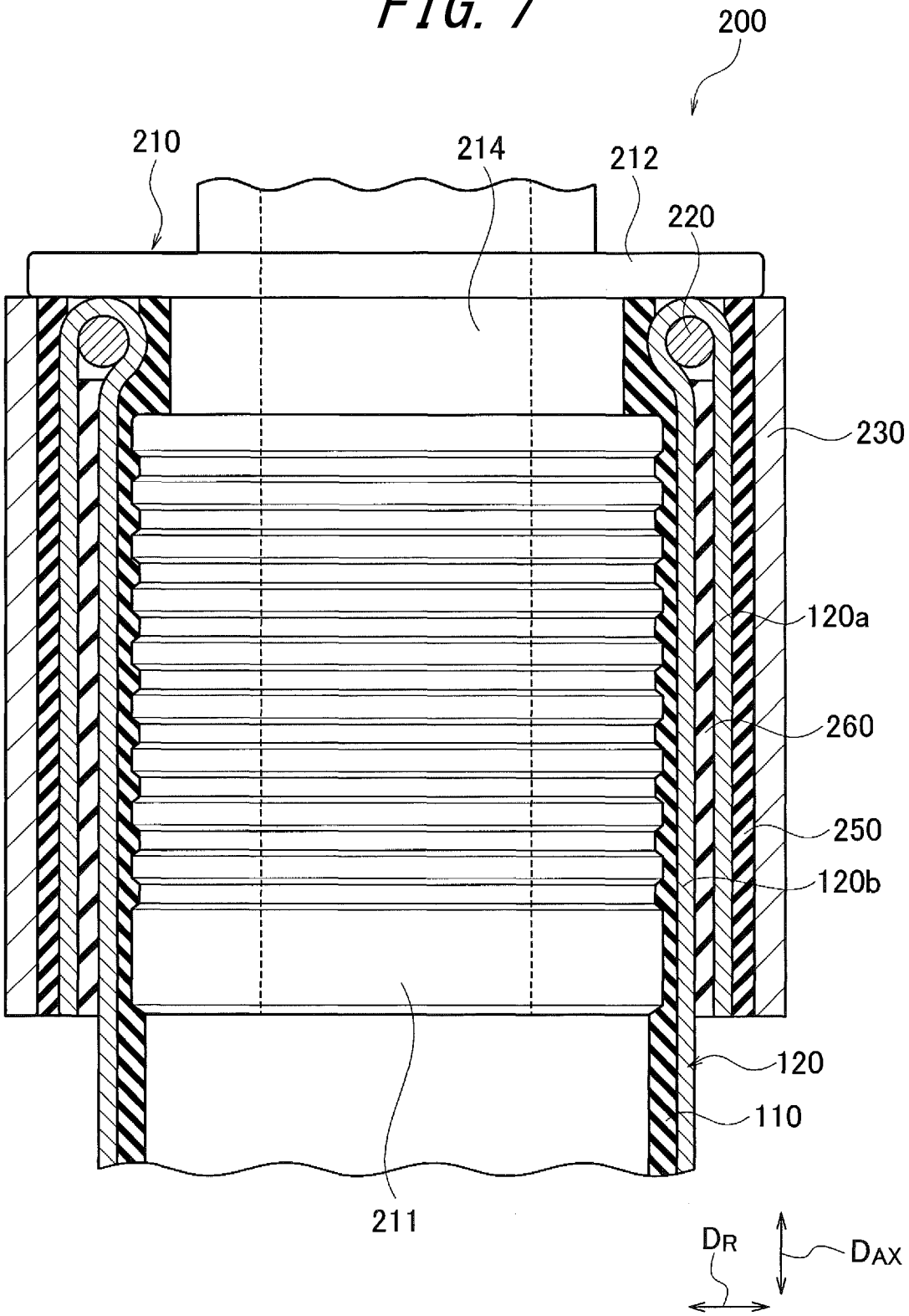
FIG. 7 is a partial cross-sectional view along the axial direction $D_{AX}$ of the pneumatic actuator 10 including the sealing mechanism 200 according to Embodiment 1-3.

FIG. 7 is a partial cross-sectional view along the axial direction $D_{AX}$ of the pneumatic actuator 10 including the sealing mechanism 200 according to Embodiment 1-3.

In Embodiment 1-3, a rubber sheet 260 is used instead of the adhesion layer 240 in Embodiment 1-1. The rubber sheet 260 is a sheet-like elastic member, and is provided between the sleeve body portion 120*b* and the first folded portion 120*a*. The rubber sheet 260 may be made of the same type of rubber as the rubber sheet 250.

(2.4) Embodiment 2-1

Figure 8:
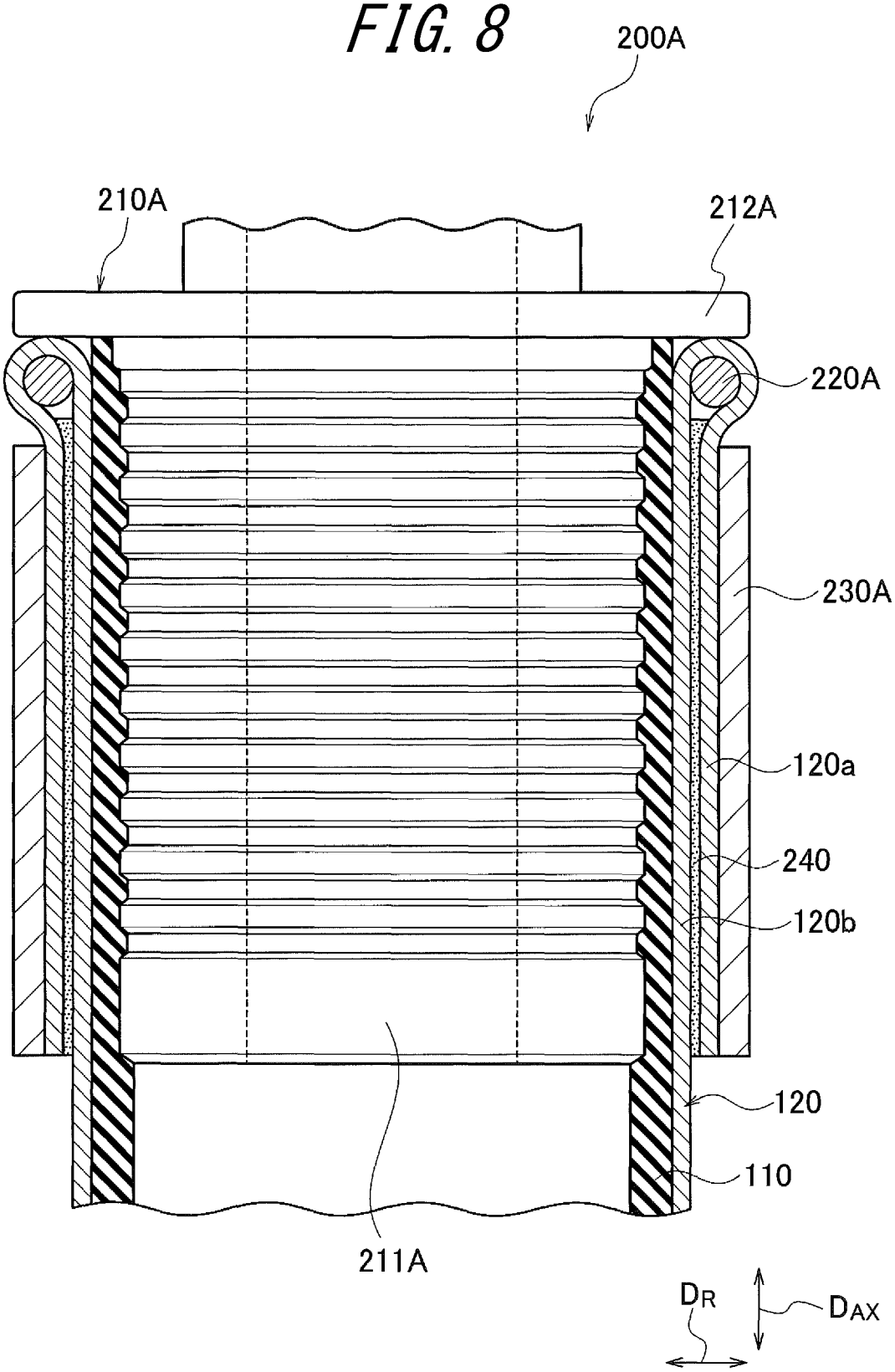
FIG. 8 is a partial cross-sectional view along the axial direction $D_{AX}$ of the pneumatic actuator 10 including a sealing mechanism 200A according to Embodiment 2-1.

FIG. 8 is a partial cross-sectional view along the axial direction $D_{AX}$ of the pneumatic actuator 10 including a sealing mechanism 200A according to Embodiment 2-1.

In Embodiment 2-1, the sealing mechanism 200A is used instead of the sealing mechanism 200 in Embodiment 1. The sealing mechanism 200A differs from the scaling mechanism 200 in that it docs not include the first small diameter portion 214 included in the sealing member 210.

The sealing mechanism 200A includes a sealing member 210A, a first locking ring 220A, and a caulking member 230A.

A body portion 211A of the sealing member 210A is inserted into the tube 110. Since the sealing member 210A does not include the first small diameter portion 214 included in the sealing member 210, the outer diameter of the first locking ring 220A is larger than the outer diameter of the body portion 211A. Hence, the first locking ring 220A is locked by the flange portion 212A and the caulking member 230A.

Because the outer diameter of the first locking ring 220A is larger than the outer diameter of the body portion 211A, the caulking member 230A is not in contact with the flange portion 212A. That is, the part of the first locking ring 220A via which the sleeve 120 is folded is exposed to the outside. Moreover, because the outer diameter of the first locking ring 220A is larger than the outer diameter of the body portion 211A, the first locking ring 220A need not be divided like the first locking ring 220 in Embodiment 1.

The adhesion layer 240 is formed between the sleeve body portion 120*b* and the first folded portion 120*a*, as in Embodiment 1-1.

(2.5) Embodiment 2-2

Figure 9:
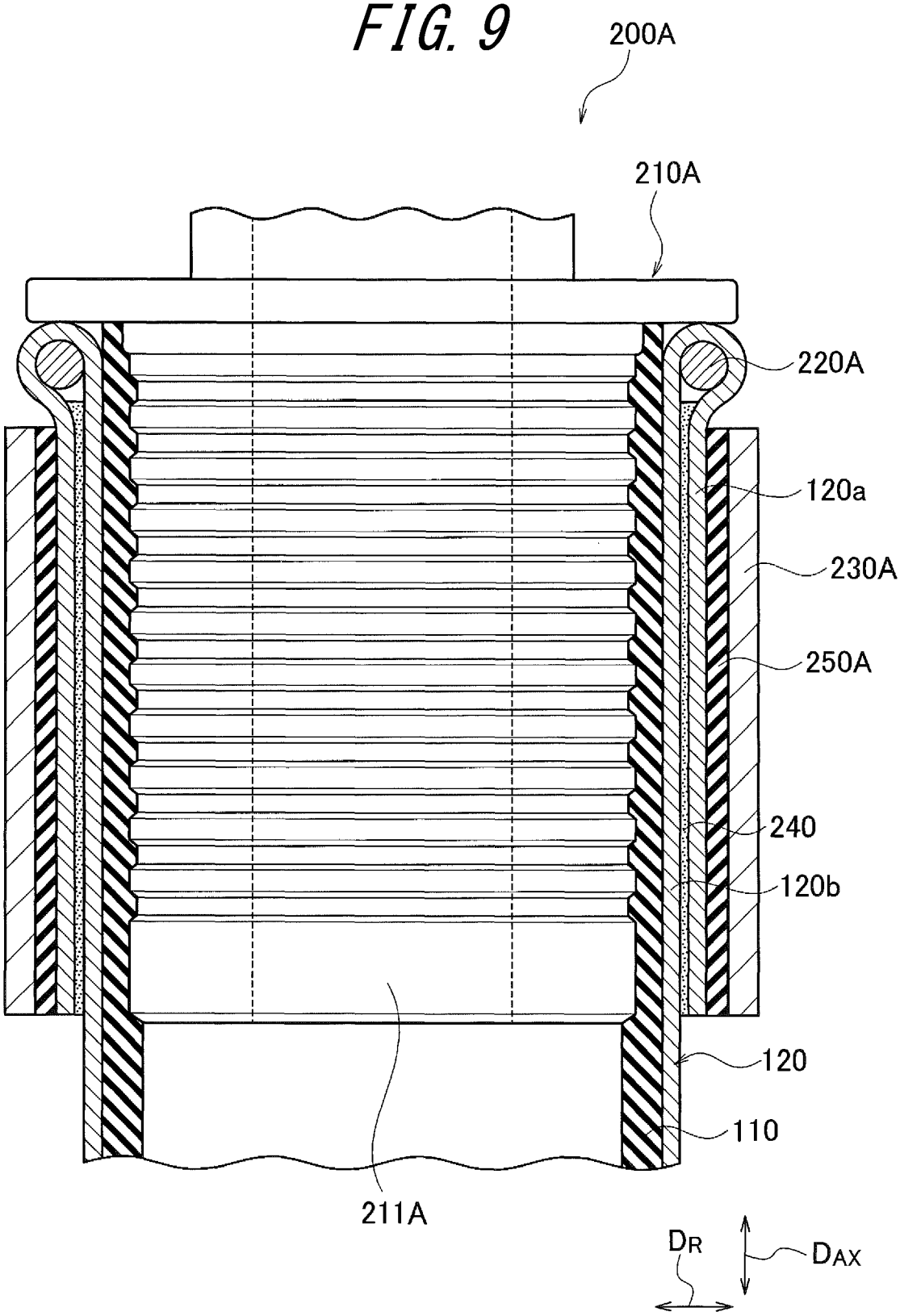
FIG. 9 is a partial cross-sectional view along the axial direction $D_{AX}$ of the pneumatic actuator 10 including the sealing mechanism 200A according to Embodiment 2-2.

FIG. 9 is a partial cross-sectional view along the axial direction $D_{AX}$ of the pneumatic actuator 10 including the sealing mechanism 200A according to Embodiment 2-2. The differences from Embodiment 2-1 will be mainly described below.

In the first folded portion 120*a* of the sleeve 120 and the caulking member 230A. Specifically, a rubber sheet 250A is provided between the first folded portion 120*a* and the caulking member 230A. The rubber sheet 250A is provided so as to cover the outer peripheral surface of the cylindrical first folded portion 120*a*, as with the rubber sheet 250 in Embodiment 1-2.

(2.6) Embodiment 2-3

Figure 10:
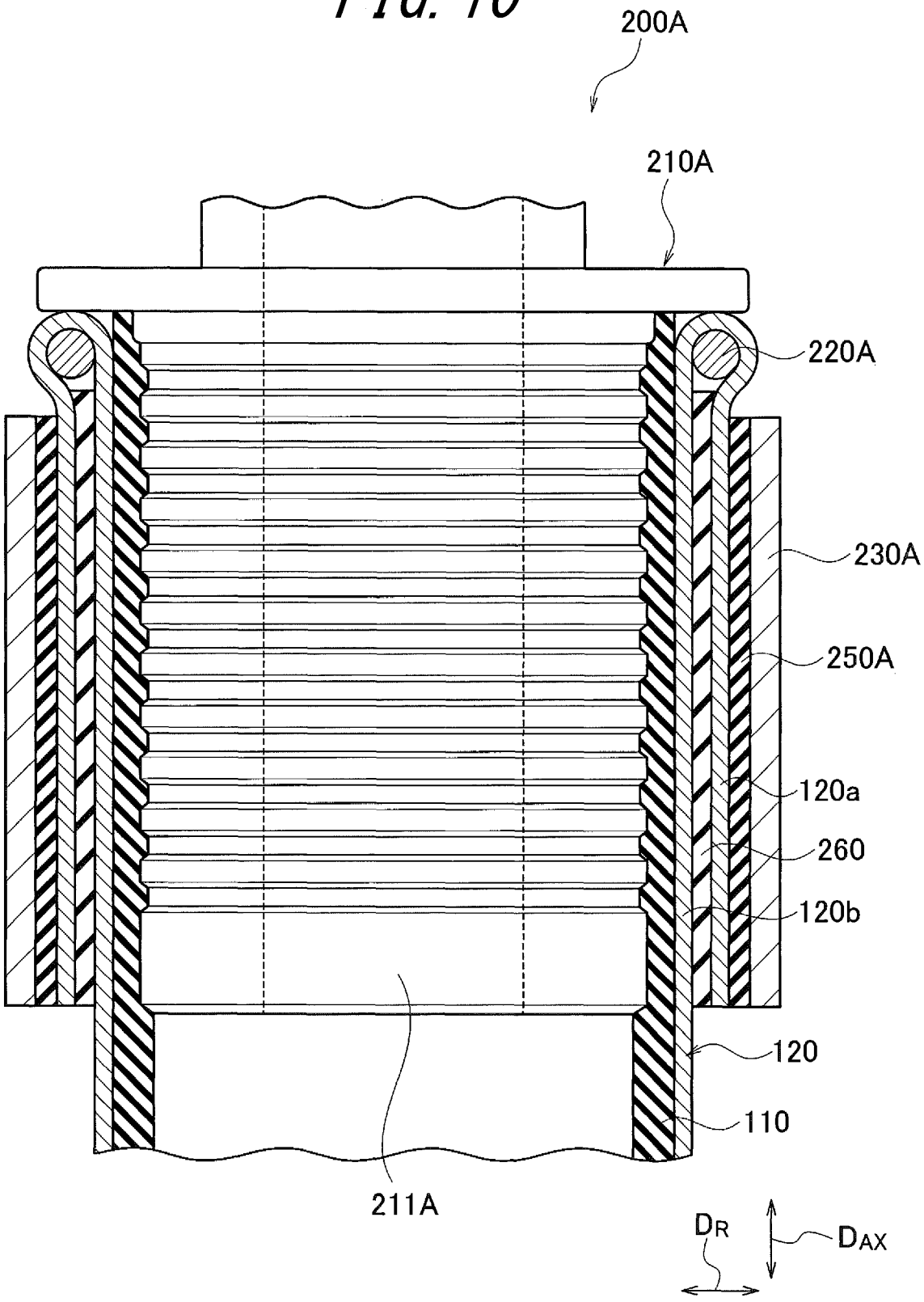
FIG. 10 is a partial cross-sectional view along the axial direction $D_{AX}$ of the pneumatic actuator 10 including the sealing mechanism 200A according to Embodiment 2-3.

FIG. 10 is a partial cross-sectional view along the axial direction $D_{AX}$ of the pneumatic actuator 10 including the sealing mechanism 200A according to Embodiment 2-3.

In Embodiment 2-3, a rubber sheet 260 is used instead of the adhesion layer 240 in Embodiment 2-1. The rubber sheet 260 is a sheet-like elastic member, and is provided between the sleeve body portion 120*b* and the first folded portion 120*a*, as in Embodiment 1-3.

(2.7) Embodiment 3-1

Figure 11:
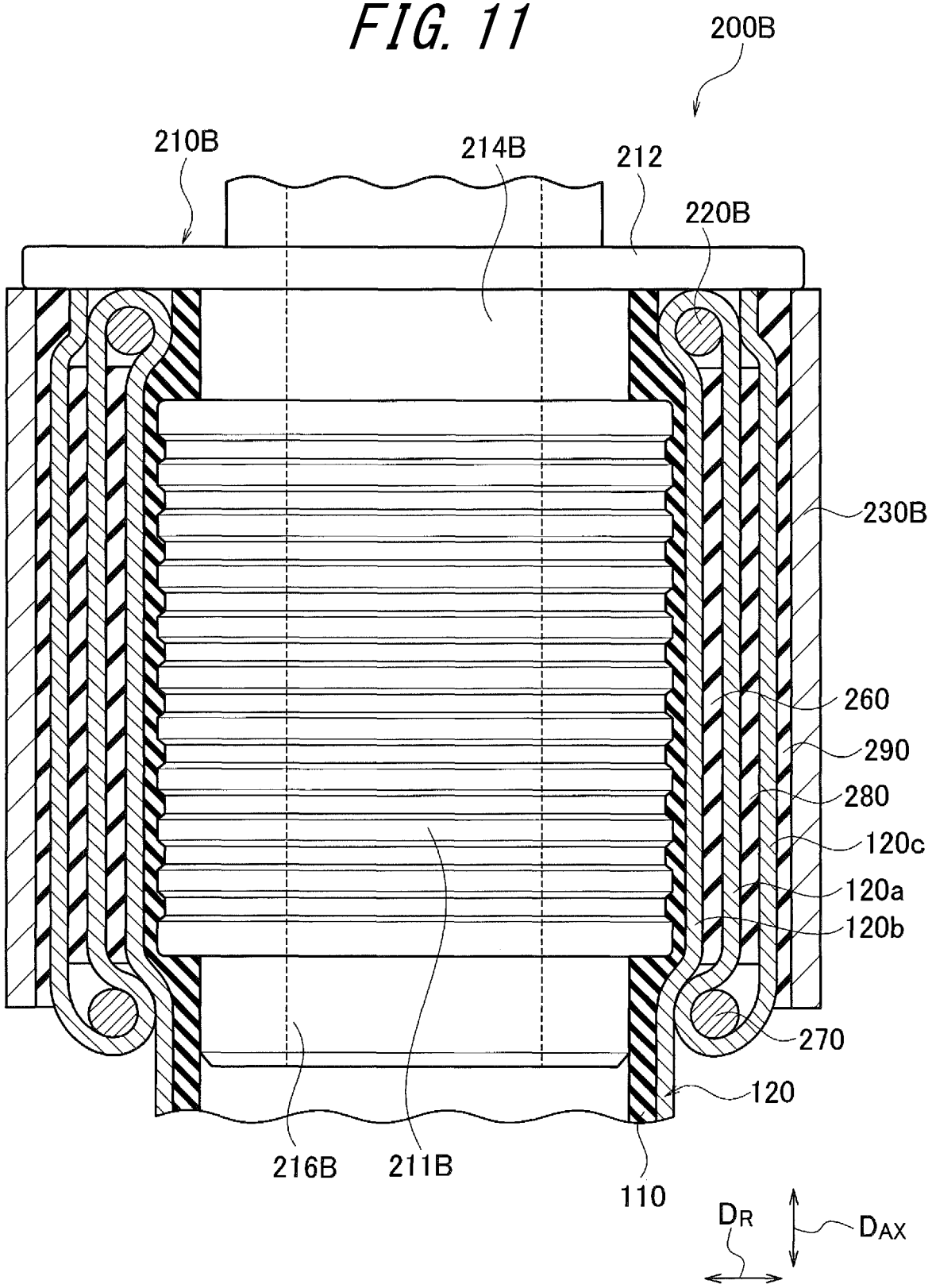
FIG. 11 is a partial cross-sectional view along the axial direction $D_{AX}$ of the pneumatic actuator 10 including a sealing mechanism 200B according to Embodiment 3-1.

FIG. 11 is a partial cross-sectional view along the axial direction $D_{AX}$ of the pneumatic actuator 10 including a sealing mechanism 200B according to Embodiment 3-1. In Embodiment 3 (3-1 and 3-2), two locking rings are used.

As illustrated in FIG. 11, the sealing mechanism 200B includes a sealing member 210B, a first locking ring 220B, a caulking member 230B, and a second locking ring 270.

Thus, the sealing mechanism 200B includes the second locking ring 270 in addition to the first locking ring 220B. The second locking ring 270 locks the sleeve 120 at a position that is on the outer side of a body portion 211B in the radial direction $D_R$ and closer to the center of the actuator body 100 in the axial direction $D_{AX}$ than the first locking ring 220B.

Specifically, the scaling member 210B includes a second small diameter portion 216B whose outer diameter is smaller than the outer diameter of the body portion 211B.

The second locking ring 270 is located on the outer side of the second small diameter portion 216B in the radial direction $D_R$. The inner diameter of the second locking ring 270 is preferably smaller than the outer diameter of the body portion 211B. The outer diameter of the second locking ring 270 may be smaller than the outer diameter of the body portion 211B. Thus, the second locking ring 270 is locked by the second small diameter portion 216B.

The sleeve 120 includes a second folded portion 120*c* folded via the second locking ring 270. The second folded portion 120*c* connects to the first folded portion 120*a*. That is, the second folded portion 120*c* is located on the outer peripheral side of the first folded portion 120*a* as a result of being folded at the end of the first folded portion 120*a* in the axial direction $D_{AX}$. Specifically, the sleeve 120 forms the first folded portion 120*a* as a result of being folded via the first locking ring 220B toward the center of the actuator body 100 in the axial direction $D_{AX}$. The sleeve 120 further forms the second folded portion 120*c* as a result of the first folded portion 120*a* being folded toward the end of the actuator body 100 in the axial direction $D_{AX}$.

The caulking member 230B caulks the lube 110 into which the body portion 211B is inserted, the sleeve body portion 120*b* located on the outer side of the tube 110 in the radial direction $D_R$, the first folded portion 120*a*, and the second folded portion 120*c*, together with the sealing member 210B.

The same rubber sheet 260 as in Embodiment 1-3 is provided between the sleeve body portion 120*b* and the first folded portion 120*a*.

Moreover, a sheet-like clastic member is provided between the first folded portion 120*a* and the second folded portion 120*c*. Specifically, a rubber sheet 280 is provided between the first folded portion 120*a* and the second folded portion 120*c*. The rubber sheet 280 is provided so as to cover the outer peripheral surface of the cylindrical first folded portion 120*a*.

Further, a rubber sheet 290 having approximately the same shape as the rubber sheet 250 in Embodiment 1-3 is provided between the second folded portion 120*c* and the caulking member 230B. The rubber sheet 290 is provided so as to cover the outer peripheral surface of the cylindrical second folded portion 120*c*.

(2.8) Embodiment 3-2

Figure 12:
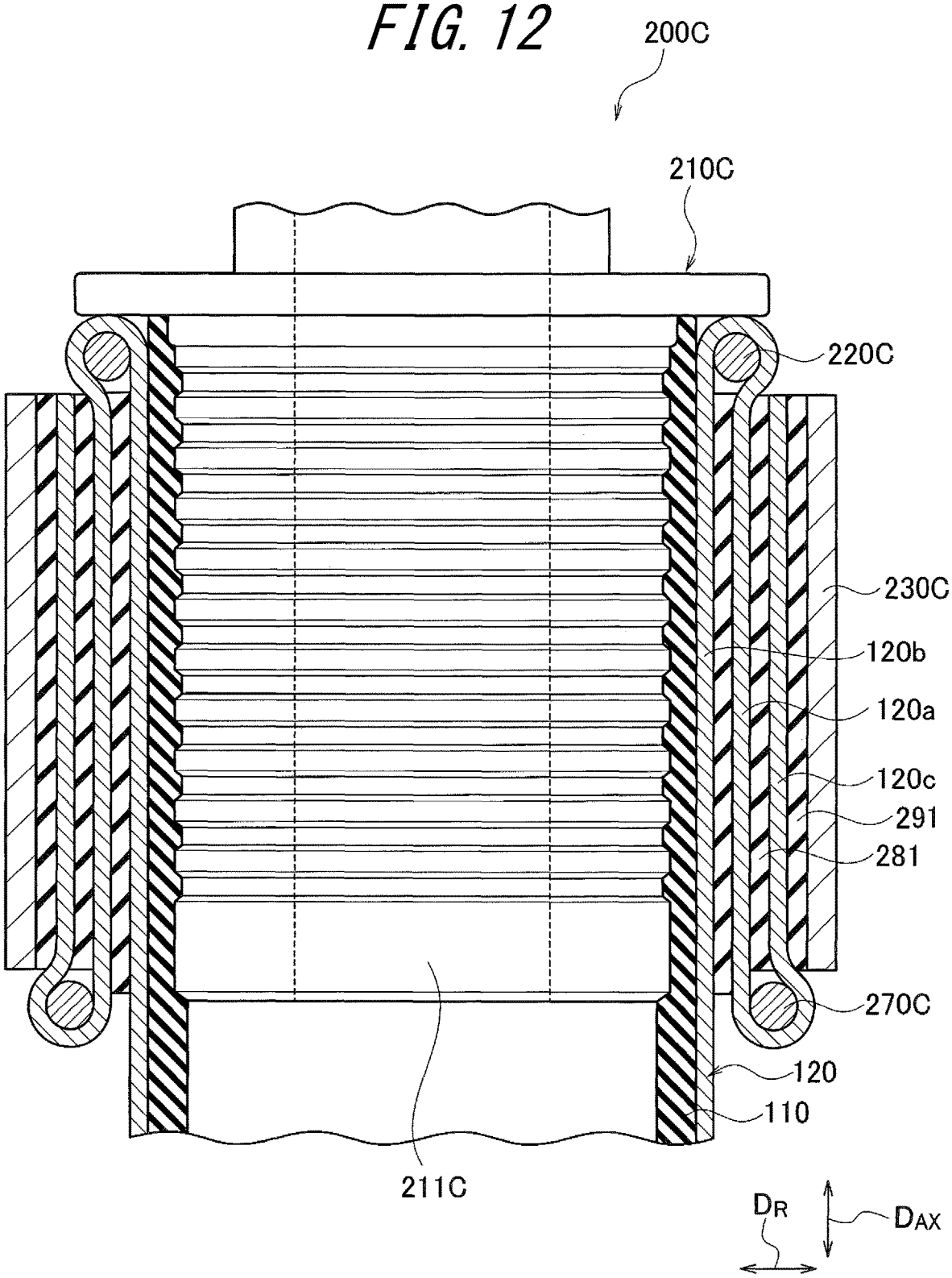
FIG. 12 is a partial cross-sectional view along the axial direction $D_{AX}$ of the pneumatic actuator 10 including a sealing mechanism 200C according to Embodiment 3-2.

FIG. 12 is a partial cross-sectional view along the axial direction $D_{AX}$ of the pneumatic actuator 10 including a sealing mechanism 200C according to Embodiment 3-2. The differences from Embodiment 3-1 will be mainly described below.

In Embodiment 3-2, a sealing member 210C not including the first small diameter portion 214B and the second small diameter portion 216B is used.

The sealing member 210C includes a body portion 211C. The sealing member 210C does not include the first small diameter portion 214B and the second small diameter portion 216B included in the sealing member 210B, so that the inner diameter of a first locking ring 220C and the inner diameter of a second locking ring 270C are each larger than the outer diameter of the body portion 211C.

A caulking member 230C is located between the first locking ring 220C and the second locking ring 270C in the axial direction $D_{AX}$. That is, the part of the first locking ring 220C and the part of the second locking ring 270C via which the sleeve 120 is folded are exposed to the outside.

A rubber sheet 281 having approximately the same shape as the rubber sheet 280 in Embodiment 3-1 is provided between the first folded portion 120*a* and the second folded portion 120*c*. A rubber sheet 291 having approximately the same shape as the rubber sheet 290 in Embodiment 3-1 is provided between the second folded portion 120*c* of the sleeve 120 and the caulking member 230C.

EXAMPLES

The presently disclosed techniques will be described in more detail below by way of examples, although the present disclosure is not limited to the examples below.

(Production of Tube)

A rubber composition is prepared by kneading, with a Banbury mixer, 45 parts by mass of high-nitrile NBR (acrylonitrile-butadiene rubber. "N220S" produced by JSR Corporation), 35 parts by mass of intermediate-high-nitrile NBR (acrylonitrile-butadiene rubber, "N230S" produced by JSR Corporation). 20 parts by mass of BR (butadiene rubber, "UBEPOL® BR150" (UBEPOL is a registered trademark in Japan, other countries, or both) produced by Ube Industries, Ltd.). 50 parts by mass of carbon black ("Seast 3" produced by Tokai Carbon Co., Ltd.), 1 part by mass of stearic acid ("Stearic Acid 50S" produced by New Japan Chemical Co., Ltd.), 2 parts by mass of an age resistor ("NOCRAC 6C" produced by Ouchi Shinko Chemical industrial Co., Ltd.), 10 parts by mass of resin ("Quintone 100" produced by Zeon Corporation), 8 parts by mass of a plasticizer ("SANSO CIZER DOA" produced by New Japan Chemical Co., Ltd.). 5 parts by mass of zinc oxide (ZnO, "No. 3 Zinc White" produced by Hakusui Tech Co., Ltd.), 1 part by mass of sulfur ("Sulfax Z" produced by Tsurumi Chemical industry Co., Ltd.), 1 part by mass of vulcanization accelerator CBS ("NOCCELER CZ" produced by Ouchi Shinko Chemical Industrial Co., Ltd.), and 2 parts by mass of vulcanization accelerator TOT ("NOCCELER TOT-N" produced by Ouchi Shinko Chemical Industrial Co., Ltd.).

The obtained rubber composition is processed by an extrusion molding machine, to produce a cylindrical tube of 300 mm in length. The outer diameter and the thickness of each produced tube are listed in Table 1.

(Production of Sleeve)

64 aramid fiber cords of the specifications listed in Table 1 are woven to prepare a cylindrical sleeve in a mesh shape. Each aramid fiber cord is produced by subjecting aramid fibers of original yarns to first twist and further subjecting them to final twist. The sleeve is a mesh-shaped tubular to body With 64 aramid fiber cords being observed on the circumference in cross-section.

The sleeve is a mesh-shaped tubular body formed by alternately weaving 32 aramid fiber cords arranged at regular spacing, in parallel, and in a spiral shape and other 32 aramid fiber cords intersecting obliquely with the 32 ararnid fiber cords and arranged at regular spacing, in parallel, and in a spiral shape. As illustrated in FIG. 3A, every two cords of one cord group and every two cords of the other cord group are alternately crossed, with the crossing position being shifted by one cord (twill weave (twill)).

The specifications of each sleeve and the cords constituting the sleeve are listed in Table 1.

(Production of Actuator)

The foregoing tube and mesh-shaped sleeve are used to produce an actuator having the structure illustrated in FIGS. 1 and 2. Air is used as the working fluid of the tube incorporated in the actuator. The angle of the cords constituting the sleeve of the produced actuator and the durability of the actuator are evaluated by the following methods.

<Evaluation Method for Angle of Cords Constituting Sleeve>

The angle of the cords constituting the sleeve with respect to the axial direction of the actuator is calculated in the following manner:

(1) photograph the relevant part, (2) select the center part (during contraction of the actuator, a region in which the diameter of the sleeve is within a range of −5% with respect to the maximum diameter of the sleeve) of the actuator where the photograph is in focus and image quality sufficient for analysis is ensured, (3) in this part, measure the angle between a straight line connecting the centers of the scaling mechanisms and the cords constituting the sleeve, and (4) evaluate five points and calculate the average as a measured value.

The angle of the cords is measured in a no-load and no-pressure state and during contraction of the actuator under a prescribed load and air pressure (internal pressure). The former is indicated as "initial cord angle $\Theta_1$" and the latter as "cord angle during contraction $\Theta_2$" in the table.

<Evaluation Method for Total Area (S2) of Gaps of Cords Constituting Sleeve>

The load on the actuator is adjusted so that the average angle of the cords constituting the sleeve with respect to the axial direction of the actuator is 45 degrees with an air pressure of 5 MPa, a photograph is taken in the same way as "Evaluation method for angle of cords constituting sleeve", and the total area (S2) of the gaps of the cords is measured. Using this value (S2), the ratio (S2/S1) is calculated from the value of the area (S1) of the outer surface of the actuator body. The ratio (S2/S1) is indicated as "gap rate during contraction (S2/S1)" in the table. In the measurement of the angle of the cords, the error range is ±1 degree.

<Evaluation Method for Durability of Actuator>

Air is injected into the tube as the working fluid. The working fluid injection operation is performed so that the pressure of the working fluid in the tube alternates between 0 MPa and 5 MPa at intervals of 3 seconds, and the number of times until the tube cracks and the actuator function can no longer be exhibited is measured. The result is indicated as an index, with the number of times in Example 1 being 100. A higher index value corresponds to higher durability.

Moreover, the failure form is visually observed, and evaluated based on the following criteria:

A: failure due to damage of the tube in a part in direct contact with cords

B: failure due to damage of the tube in a part not in direct contact with cords

C: failure due to cutting of cords.

TABLE 1

| | | | Example 1 | Example 2 | Example 3 | Example 4 | Example 5 | Example 6 | Comparative Example 1 | Comparative Example 2 | Comparative Example 3 |
|---|---|---|---|---|---|---|---|---|---|---|---|
| Tube | Tube outer diameter | mm | 13.0 | 13.0 | 13.0 | 13.0 | 13.0 | 13.0 | 13.0 | 13.0 | 13.0 |
| | Tube thickness t | mm | 2 | 2.2 | 2 | 2.2 | 2.2 | 2.2 | 2 | 2 | 2 |
| Sleeve | Initial cord angle $\Theta_1$ (no-load and no-pressure) | degrees | 25 | 25 | 25 | 25 | 25 | 25 | 25 | 25 | 25 |
| | Gap rate during contraction (S2/S1) | % | 31.9 | 11.1 | 26.8 | 8.7 | 18.8 | 16.4 | 35.2 | 47.4 | 42 |
| | Cord angle during contraction $\Theta_2$ | degrees | 53.1 | 52.3 | 51.3 | 51.2 | 51.9 | 51.0 | 53.0 | 52.1 | 52.9 |
| | Cord diameter d | mm | 0.51 | 0.71 | 0.47 | 0.71 | 0.71 | 0.83 | 0.51 | 0.33 | 0.56 |
| | Right side of Formula (1) | mm | 0.68 | 0.67 | 0.66 | 0.66 | 0.67 | 0.66 | 0.68 | 0.67 | 0.68 |
| | Right side of Formula (2) | mm | 1.82 | 2.01 | 1.77 | 2.01 | 2.01 | 2.13 | 1.82 | 1.63 | 1.87 |
| | Sleeve inner diameter | mm | 14.1 | 14.1 | 14.1 | 14.1 | 14.1 | 14.1 | 14.1 | 14.1 | 14.1 |
| | Original yarn | dtex | 2200 | 2200 | 1100 | 2200 | 2200 | 3600 | 2200 | 1100 | 1100 |

TABLE 1-continued

| | | | Example 1 | Example 2 | Example 3 | Example 4 | Example 5 | Example 6 | Comparative Example 1 | Comparative Example 2 | Comparative Example 3 |
|---|---|---|---|---|---|---|---|---|---|---|---|
| | fineness D | | | | | | | | | | |
| | Original yarn density ρ | g/cm³ | 1.44 | 1.44 | 1.44 | 1.44 | 1.44 | 1.44 | 1.44 | 1.44 | 1.44 |
| | Cord first twist count $T_1$ | turns/10 cm | 28 | 12 | 15 | 12 | 12 | 28 | 28 | 36 | 58 |
| | Cord final twist count $T_2$ | turns/10 cm | 28 | 12 | 15 | 12 | 12 | 28 | 28 | 36 | 52 |
| | Number of original yarns twisted | yarns per cord | 2 | 2 | 2 | 2 | 2 | 2 | 2 | 2 | 2 |
| | Cord twist coefficient K | — | 0.387 | 0.166 | 0.147 | 0.166 | 0.166 | 0.495 | 0.387 | 0.352 | 0.508 |
| | $T_1/D$ | — | 0.013 | 0.005 | 0.014 | 0.005 | 0.005 | 0.008 | 0.013 | 0.033 | 0.053 |
| | $T_1/T_2$ | — | 1.0 | 1.0 | 1.0 | 1.0 | 1.0 | 1.0 | 1.0 | 1.0 | 1.1 |
| | Breaking strength of cords | N per cord | 615 | 633 | 340 | 633 | 633 | 918 | 6.15 | 312 | 254 |
| | Breaking elongation of cords | % | 5.2 | 4.9 | 4.8 | 4.9 | 4.9 | 4.6 | 5.2 | 4.5 | 6.2 |
| | Driving density of cords | cords/cm | 15.6 | 15.6 | 23.3 | 15.6 | 11.7 | 11.7 | 11.7 | 11.7 | 15.6 |
| | Method of weaving cords | — | Twill weave | Twill weave | Twill weave | Twill weave | Twill weave | Twill weave | Twill weave | Twill weave | Twill weave |
| Evaluation | Durability | index | 100 | 313 | 215 | 575 | 488 | 538 | 63 | 25 | 22 |
| | Failure form | — | A | A | A | A | A | A | B | C | A |

As can be understood from Table 1, the pneumatic actuators according to the present disclosure have high durability.

REFERENCE SIGNS LIST

10 pneumatic actuator
20 connection portion
100 actuator body
110 tube
120 sleeve
120*a* first folded portion
120*b* sleeve body portion
120*c* second folded portion
121 cord
121A, 121B cord group
122 gap of cord
200, 200A, 200B, 200C sealing mechanism
210, 210A, 210B, 210C sealing member
211, 211A, 211B, 211C body portion
212, 212A flange portion
213 recess and projection portion
214, 214B first small diameter portion
215 passage hole
216B second small diameter portion
220, 220A, 220B, 220C first locking ring
230, 230A, 230B, 230C caulking member
231 pressed mark
240 adhesion layer
250, 250A rubber sheet
260 rubber sheet
270, 270C second locking ring
280, 281 rubber sheet
290, 291 rubber sheet
300 sealing mechanism
400, 500 fitting
410, 510 passage hole
$D_{AX}$ axial direction
$D_R$ radial direction

The invention claimed is:

1. A pneumatic actuator comprising an actuator body including: a cylindrical lube configured to expand and contract by air pressure; and a sleeve that is a cylindrical structure formed by weaving cords oriented in predetermined directions and covers an outer peripheral surface of the tube, wherein in a no-load and no-pressure state, an average angle of the cords constituting the sleeve with respect to an axial direction of the actuator is 20 degrees or more and less than 45 degrees, and in a state in which the average angle of the cords constituting the sleeve with respect to the axial direction of the actuator is 45 degrees with an air pressure of 5 MPa, a ratio S2/S1 of a total area S2 of gaps of the cords constituting the sleeve to an area S1 of an outer surface of the actuator body is 35% or less.

2. The pneumatic actuator according to claim 1, wherein the cords constituting the sleeve are made of at least one fiber material selected from the group consisting of polyamide fiber, polyester fiber, polyurethane fiber, rayon, acrylic fiber, and polyolefin fiber.

3. The pneumatic actuator according to claim 1, wherein the sleeve is formed by alternately crossing respectively every one cord or every two cords of a cord group oriented in one direction and every one cord or every two cords of a cord group that crosses the cord group, with a position at which cords cross each other is shifted by one cord.

4. The pneumatic actuator according to claim 1, wherein the sleeve is formed by twill weaving or plain weaving the cords.

5. The pneumatic actuator according to claim 1, wherein a breaking strength of the cords constituting the sleeve is 200 N or more per cord.

6. The pneumatic actuator according to claim 1, wherein a breaking elongation of the cords constituting the sleeve is 2.0% or more.

7. The pneumatic actuator according to claim 1, wherein a diameter of the cords constituting the sleeve is 0.3 mm to 1.5 mm.

8. The pneumatic actuator according to claim 1, wherein a driving density of the cords constituting the sleeve is 6.8 cords/cm to 25.5 cords/cm.

9. The pneumatic actuator according to claim 1, wherein a thickness t of the tube in mm, a diameter d of the cords constituting the sleeve in mm, an average angle $\Theta_1$ of the cords constituting the sleeve with respect to the axial direction of the actuator in the no-load and no-pressure state, and an average angle $\Theta_2$ of the cords constituting the sleeve with respect to the axial direction of the actuator during contraction of the actuator satisfy the following Formula (1):

$$t > \sin\Theta_2 \cdot \frac{\sin(2\Theta_2)}{\sin(2\Theta_1)} \cdot \left(\frac{1}{\sin(2\Theta_1)} - \frac{1}{2\cos\Theta_2}\right) \cdot d. \quad (1)$$

10. The pneumatic actuator according to claim 9, wherein the thickness t of the tube in mm, the diameter d of the cords constituting the sleeve in mm, the average angle $\Theta_1$ of the cords constituting the sleeve with respect to the axial direction of the actuator in the no-load and no-pressure state, and the average angle $\Theta_2$ of the cords constituting the sleeve with respect to the axial direction of the actuator during contraction of the actuator satisfy the following Formula (2):

$$t > \frac{\sin(2\Theta_2)\sin(\Theta_2)}{\sin^2(2\Theta_1)} \cdot d. \quad (2)$$

11. The pneumatic actuator according to claim 1, wherein a twist coefficient K of the cords constituting the sleeve is 0.14 to 0.50, the twist coefficient K being defined by the following Formula (3):

$$K = T_2 \times \sqrt{0.125 \times \frac{D}{\rho}} \times 10^{-3} \quad (3)$$

where $T_2$ is a final twist count of the cords in turns/10 cm, D is a fineness of original yarns constituting the cords per yarn in dtex, and ρ is a density of the original yarns constituting the cords in g/cm$^3$, the final twist count $T_2$ in turns/10 cm being replaced with a first twist count $T_1$ in turns/10 cm in the case where the cords have a single-twist structure.

12. The pneumatic actuator according to claim 1, wherein in the cords constituting the sleeve, a ratio $T_1/D$ between a first twist count $T_1$ in turns/10 cm and a fineness D of original yarns constituting the cords per yarn in dtex is 0.004 to 0.03.

13. The pneumatic actuator according to claim 1, wherein in the cords constituting the sleeve, a ratio $T_1/T_2$ between a first twist count $T_1$ in turns/10 cm and a final twist count $T_2$ in turns/10 cm is 0.8 to 1.2.

14. The pneumatic actuator according to claim 1, wherein in the cords constituting the sleeve, a fineness D of original yarns constituting the cords per yarn is 800 dtex to 5000 dtex, a first twist count $T_1$ is 3.2 turns/10 cm to 150 turns/10 cm, a final twist count $T_2$ is 2.6 turns/10 cm to 180 turns/10 cm, and a number of original yarns twisted is 2 to 4.

15. The pneumatic actuator according to claim 1, wherein a thickness of the tube is 1.0 mm to 6.0 mm in the no-load and no-pressure state.

16. The pneumatic actuator according to claim 2, wherein the sleeve is formed by alternately crossing respectively every one cord or every two cords of a cord group oriented in one direction and every one cord or every two cords of a cord group that crosses the cord group, with a position at which cords cross each other is shifted by one cord.

17. The pneumatic actuator according to claim 2, wherein the sleeve is formed by twill weaving or plain weaving the cords.

18. The pneumatic actuator according to claim 2, wherein a breaking strength of the cords constituting the sleeve is 200 N or more per cord.

19. The pneumatic actuator according to claim 2, wherein a breaking elongation of the cords constituting the sleeve is 2.0% or more.

20. The pneumatic actuator according to claim 2, wherein a diameter of the cords constituting the sleeve is 0.3 mm to 1.5 mm.

* * * * *